US010793396B1

(12) United States Patent
Macareno et al.

(10) Patent No.: US 10,793,396 B1
(45) Date of Patent: Oct. 6, 2020

(54) ELEVATOR CAR DOOR INTERLOCK

(71) Applicants: Ricardo Macareno, Miami, FL (US); Nelson Alonso, Miami, FL (US)

(72) Inventors: Ricardo Macareno, Miami, FL (US); Nelson Alonso, Miami, FL (US)

( * ) Notice: Subject to any disclaimer, the term of this patent is extended or adjusted under 35 U.S.C. 154(b) by 298 days.

(21) Appl. No.: 15/351,165

(22) Filed: Nov. 14, 2016

Related U.S. Application Data

(63) Continuation-in-part of application No. 14/684,058, filed on Apr. 10, 2015, now abandoned.

(51) Int. Cl.
*B66B 13/20* (2006.01)

(52) U.S. Cl.
CPC ..... *B66B 13/20* (2013.01)

(58) Field of Classification Search
CPC ..... B66B 13/16; B66B 13/28; B66B 13/20
See application file for complete search history.

(56) References Cited

U.S. PATENT DOCUMENTS 1,425,762 A * 8/1922 Girten ..... B66B 13/16 187/280
1,476,710 A * 12/1923 Girten ..... B66B 13/16 187/280
1,615,090 A * 1/1927 Lang ..... B66B 13/16 187/280
1,649,475 A * 11/1927 Jones ..... B66B 13/16 200/61.65
3,436,863 A * 4/1969 Peelle, Jr. ..... E05F 15/665 49/362
4,603,766 A * 8/1986 Landa ..... F16D 27/10 192/109 R
4,947,964 A * 8/1990 Husmann ..... B66B 13/12 187/314

FOREIGN PATENT DOCUMENTS

WO WO-2006097997 A1 * 9/2006 ..... B66B 13/20

OTHER PUBLICATIONS

Machine Translation of WO2006097997.*

* cited by examiner

*Primary Examiner* — Diem M Tran
(74) *Attorney, Agent, or Firm* — Sanchelima & Associates, P.A.; Christian Sanchelima; Jesus Sanchelima

(57) ABSTRACT

An elevator car door safety device that uses flags along a hoistway is disclosed. The elevator car door safety device is mounted to the outside of an elevator car door using a mounting plate and includes a locking assembly mounted to the sill of the elevator car door. The car door safety device includes a lever with a hook at its distal end. The safety device also includes a flag engagement arm perpendicularly mounted to the lever. If the flag engagement arm engages a flag on the hoistway then the hook is prevented from being lodged into the locking assembly and the car door is permitted to open. Inversely, if no flag is engaged, the lever will continue to rotate urging the hook to be lodged within the locking assembly, thereby preventing the door from opening. An electric switch assembly can be used to stop the motion of the elevator.

14 Claims, 24 Drawing Sheets

ELEVATOR CAR DOOR INTERLOCK

OTHER RELATED APPLICATIONS

The present application is a continuation-in-part of continuation-in-part U.S. patent application Ser. No. 14/684,058, filed on Apr. 10, 2015 which is hereby incorporated by reference.

BACKGROUND OF THE INVENTION

1. Field of the Invention

The present invention relates to an elevator car door safety device.

2. Description of the Related Art

Several designs for elevator car door restrictors have been designed in the past. Many commercially available elevator systems have car door restrictors that require the use of rigidly mounted flags (flags are rigid structures affixed to the sides of the hoistway) along the entire length of the locking zones of the hoistway. None of them, however, include the use of flags to allow the elevator car doors to open. The flags are used to keep the elevator car doors locked except when interrupted in registration with the unlocking zone.

Alternative elevator car door restrictors rely on the elevator's clutch with several moving parts, which uses pick up rollers. Relying on these rubber pick up rollers is unreliable because they include many small moving parts and are made of substantially rubber, both are easily vulnerable to wear and tear. This requires significant maintenance. The lack of such maintenance typically leads to elevator code violations or breakdowns. Also, these types of restrictors require precise adjustments for them to work, as they require a aligned path throughout the hoistway. The present invention can work independently of any clutch that is used and does not rely on the clutch for the restrictor to work. This means that even if the clutch requires maintenance there will not be a violation or breakdown for a faulty restrictor because the restrictor works independently from the clutch. In addition, the present invention is adjustable and can readily conform to a hoistway that is not entirely straight.

Other designs for elevator car door restrictors include a bar system that is mounted to the inner elevator car door. With these designs the car doors are allowed to open at any portion throughout areas where there are no flags along the hoistway. Thus, numerous flags are required along the hoistway to keep the elevator doors locked. This leads to an added cost in elevator installations and increases the likelihood of a failure due to there being more parts that may fail. Additionally, the bar system makes it more difficult for emergency personnel to open the car doors in case of an emergency because of the challenges associated with reaching the remote bar.

Moreover, the nature of bar system requires the flags that the bar pushes up against to withstand the force of the elevator doors wanting to open. This force requires that the flags be made out of a heavier—and more costly—material. Also, if there are recesses along the hoistway, fascia must be installed to fill the space so that the flag can reach the bar system. This is yet another added expense related to the bar system.

SUMMARY OF THE INVENTION

It is one of the main objects of the present invention to provide an elevator car door restrictor and safety device system that eliminates the use of a plurality of flags throughout the locking zones along a hoistway. The present invention only uses one flag in the unlocking zone and remains locked without the use of flags if the car doors are opened in a locking zone. This reduces the costs associated with equipment, labor and maintenance.

It is another object of this invention to provide a car door restrictor and safety device system that is compatible with any hoistway and does not require fascia to cover the recesses or setbacks along the hoistway.

It is still another object of the present invention to provide a safety device system that does not rely on a critically aligned hoistway as much as other restrictor systems.

It is still another object of the present invention to provide an electrical switch that disables the elevator's driving means when the arm falls forward causing the male and female switch portions to disengage, thereby having the elevator stop running when someone attempts to open the elevator door.

It is another object of the present invention to provide a safe restrictor and safety device system that has a more secure engagement than conventional locking systems and has tighter thresholds for the amount the car door is allowed to open before the switch deactivates the driving means and the door is locked.

It is another object of the invention to provide a restrictor and a safety device system that complies with code regulations.

It is yet another object of this invention to provide such an elevator car door safety device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which:

FIG. 12 is a representation of the present invention mounted to the elevator car door and in the reset position as the elevator travels through the hoistway.

DETAILED DESCRIPTION OF THE EMBODIMENTS OF THE INVENTION

Figure 1:
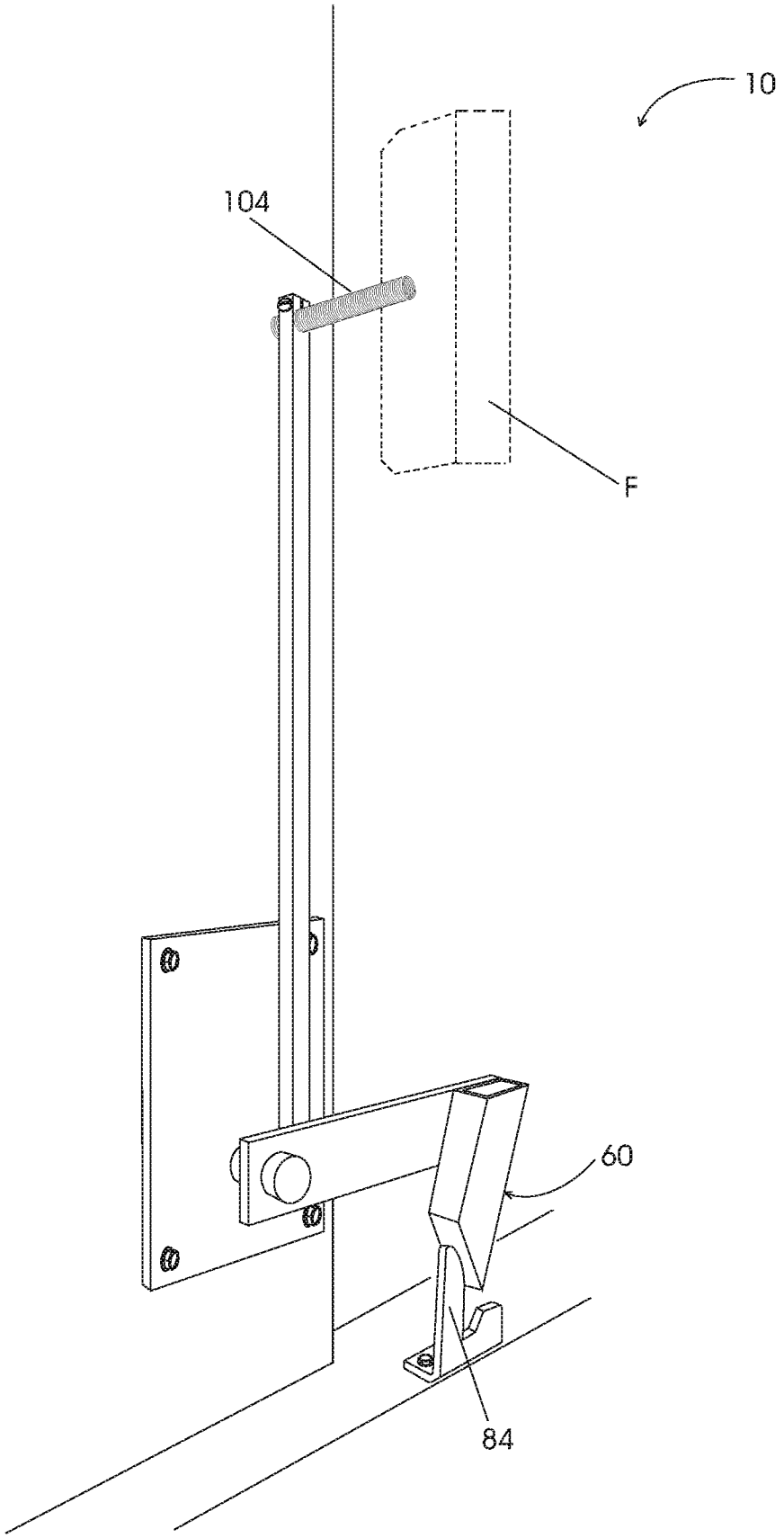
FIG. 1 represents an isometric view of an embodiment of car door restrictor 10 wherein flag engagement member 104 can be seen perpendicular flag F. Hook assembly 60 can be seen resting on reset portion 84 while elevator is traveling or at rest in the hoistway without the doors attempted to be open.

Referring now to the drawings, where the present invention is generally referred to with numeral 10, it can be observed that it basically includes mounting assembly 20, lever arm assembly 40, hook assembly 60, locking assembly 80, flag engagement assembly 100, and electric switch assembly 120.

Figure 2:
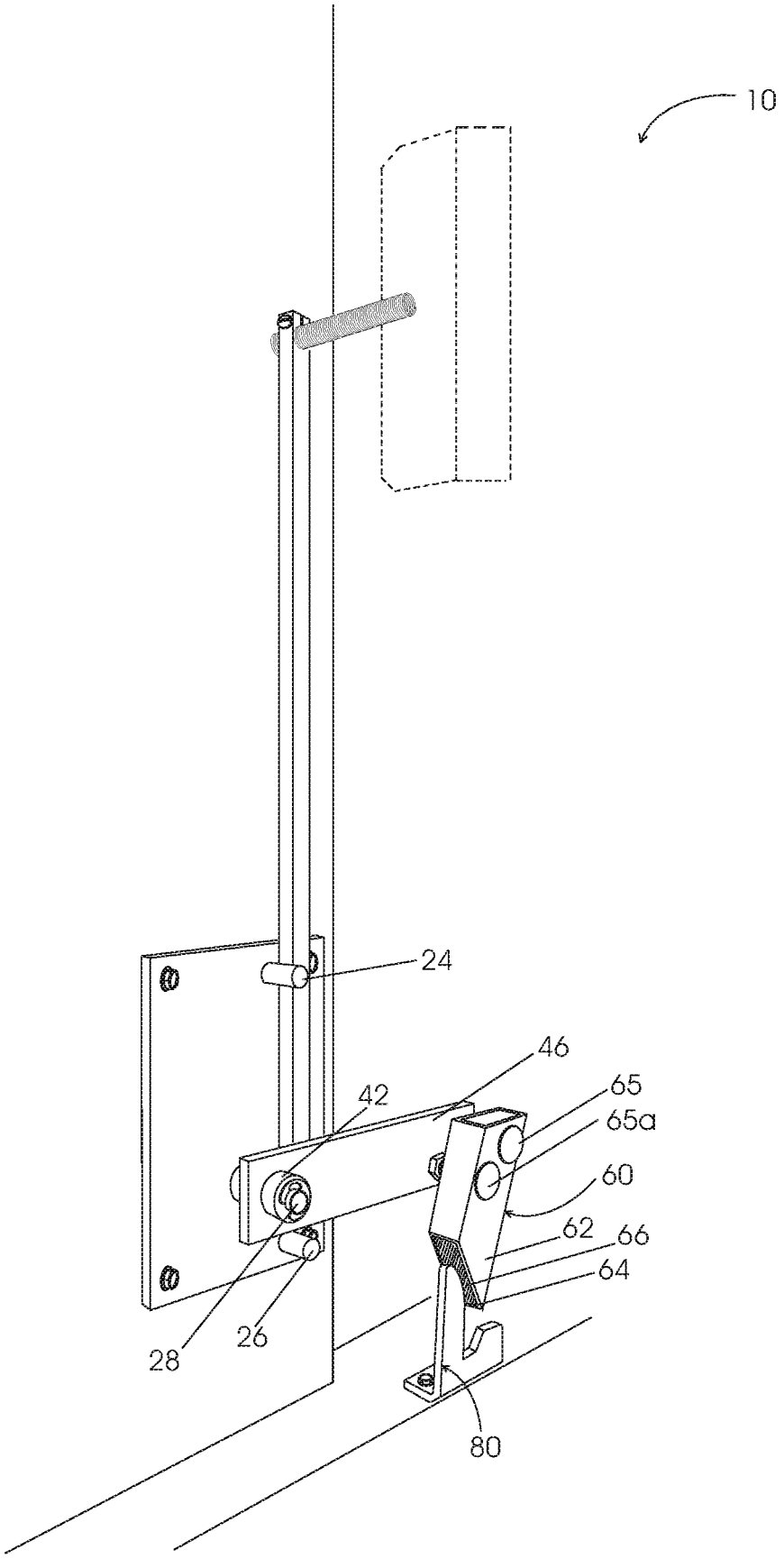
FIG. 2 shows an isometric view of an alternate embodiment of car door safety device 10 wherein sill distance adjustment members 65; 65*a* have been added to allow users to configure car door safety device 10 to sills of different dimensions. This alternate embodiment also includes top and bottom stopper pins 24 and 26, respectively. Top stopper pin 24 maintains hook assembly 60 at a proper height to enable the reset feature of the present invention. Bottom stopper pin 26 prevents hook assembly 60 from dropping too great a distance that would cause hook 62 to drag across the sill. This alternate embodiment also shows shaft 28 cooperating with bearing sleeve 42 to reduce friction created by lever arm 46. Pad 66 can be seen to reduce the coefficient of friction between hook assembly 60 and locking assembly 80.

Mounting assembly 20 includes mounting plate 22 that is mounted to the car door of an elevator. As shown in FIG. 1, mounting assembly 20 also includes shaft 28 that protrudes through lever arm assembly 40 allowing lever arm 46 to rotate. As shown in FIG. 2, mounting assembly also includes top stopper pin 24 that maintains hook assembly 60 from rotating too far back. Locking assembly 80 allows hook assembly to properly reset itself on reset portion 84.

Figure 6:
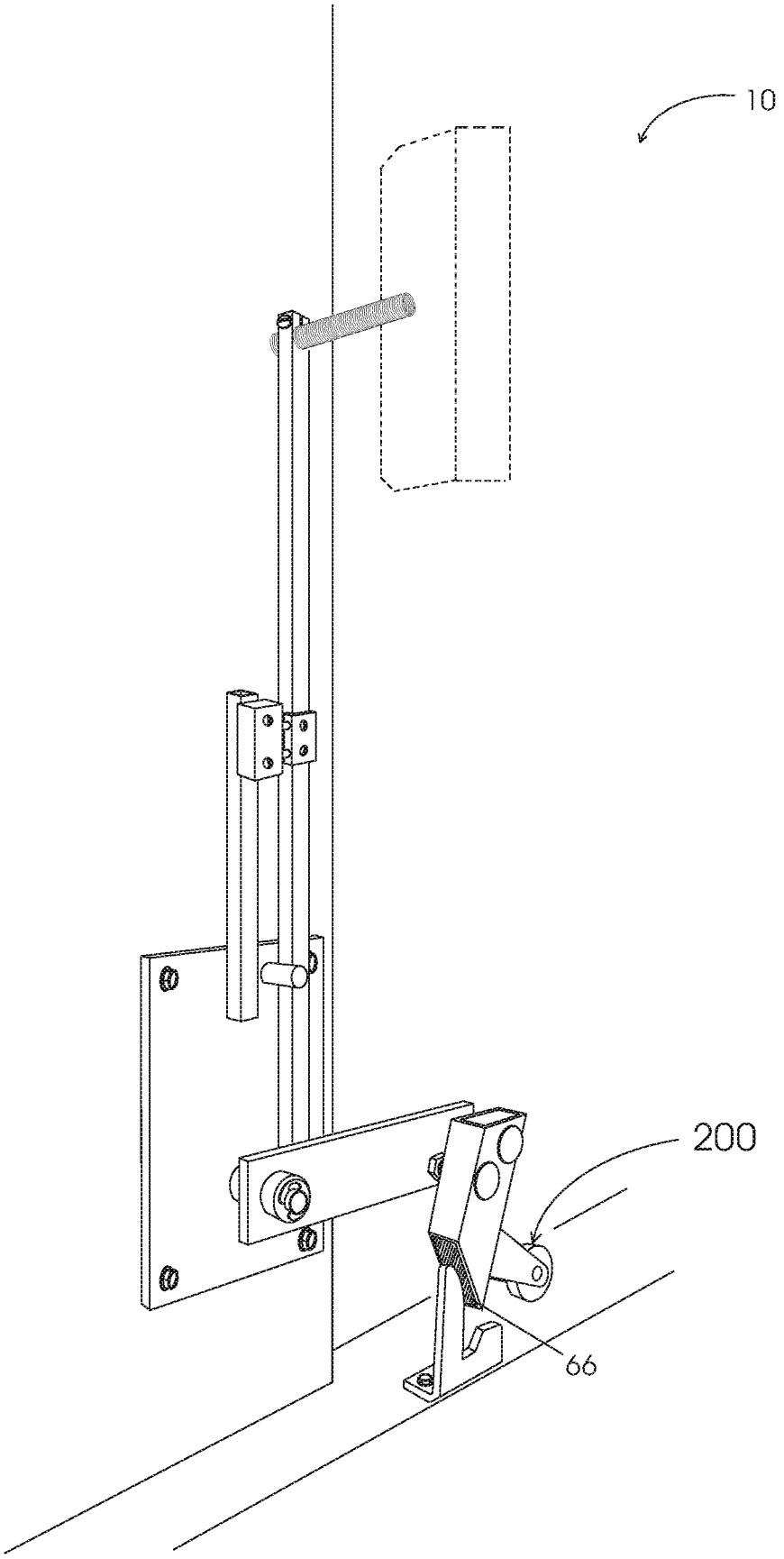
FIG. 6 shows an isometric view of another alternate embodiment for elevator car door safety device 10 wherein bottom stopper pin 26 has been removed and roller 200 is used to prevent hook 66 from dragging across the sill.
Figure 7:
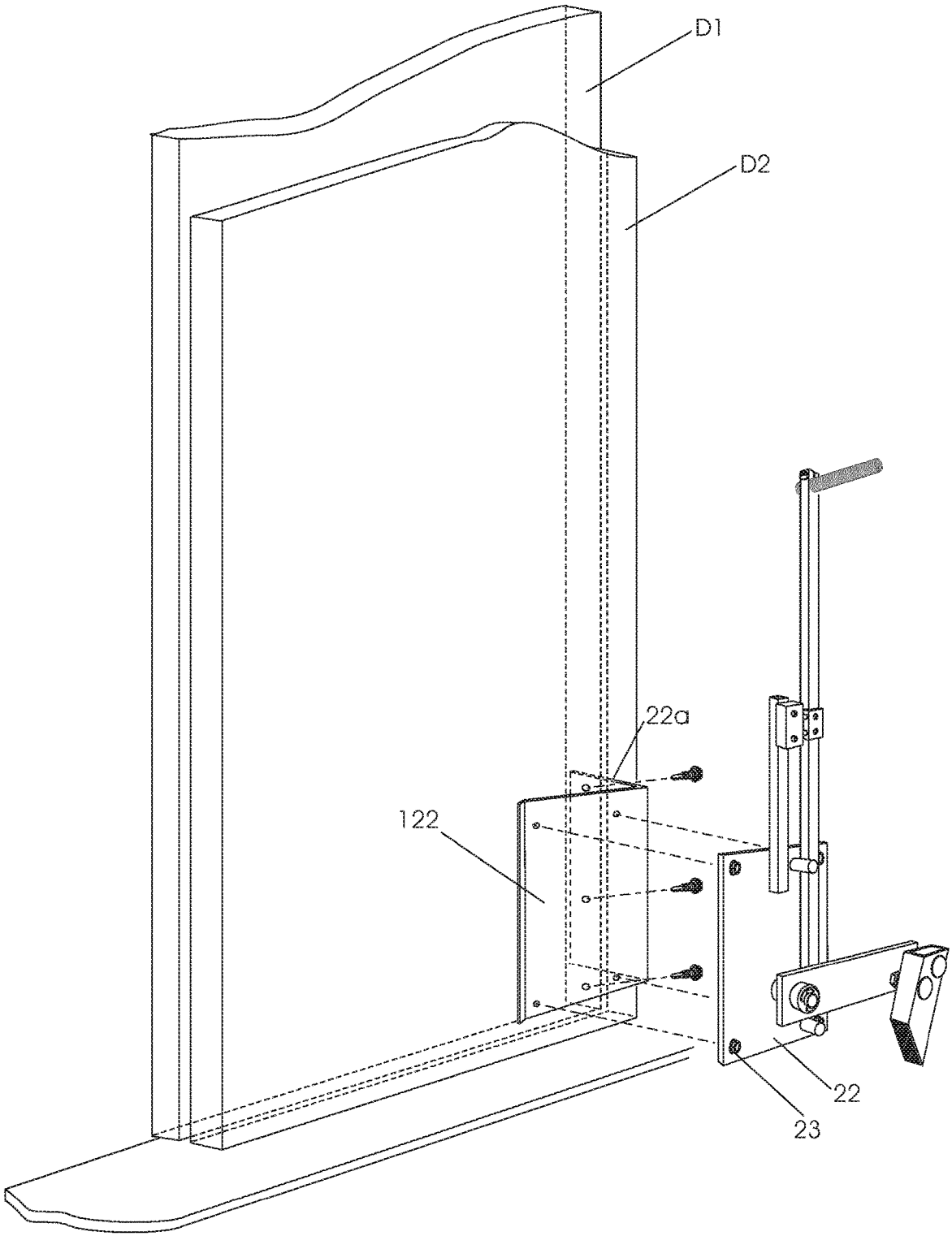
FIG. 7 illustrates an isometric view of an alternate embodiment showing fastening means 23 used to mount outer mounting plate 22 to inner mounting plate 122. Side mounting plate 122*a* can be partially seen perpendicularly mounted to inner mounting plate 122. Multi-speed doors D1 and D2 can be seen in the open position.
Figure 7A:
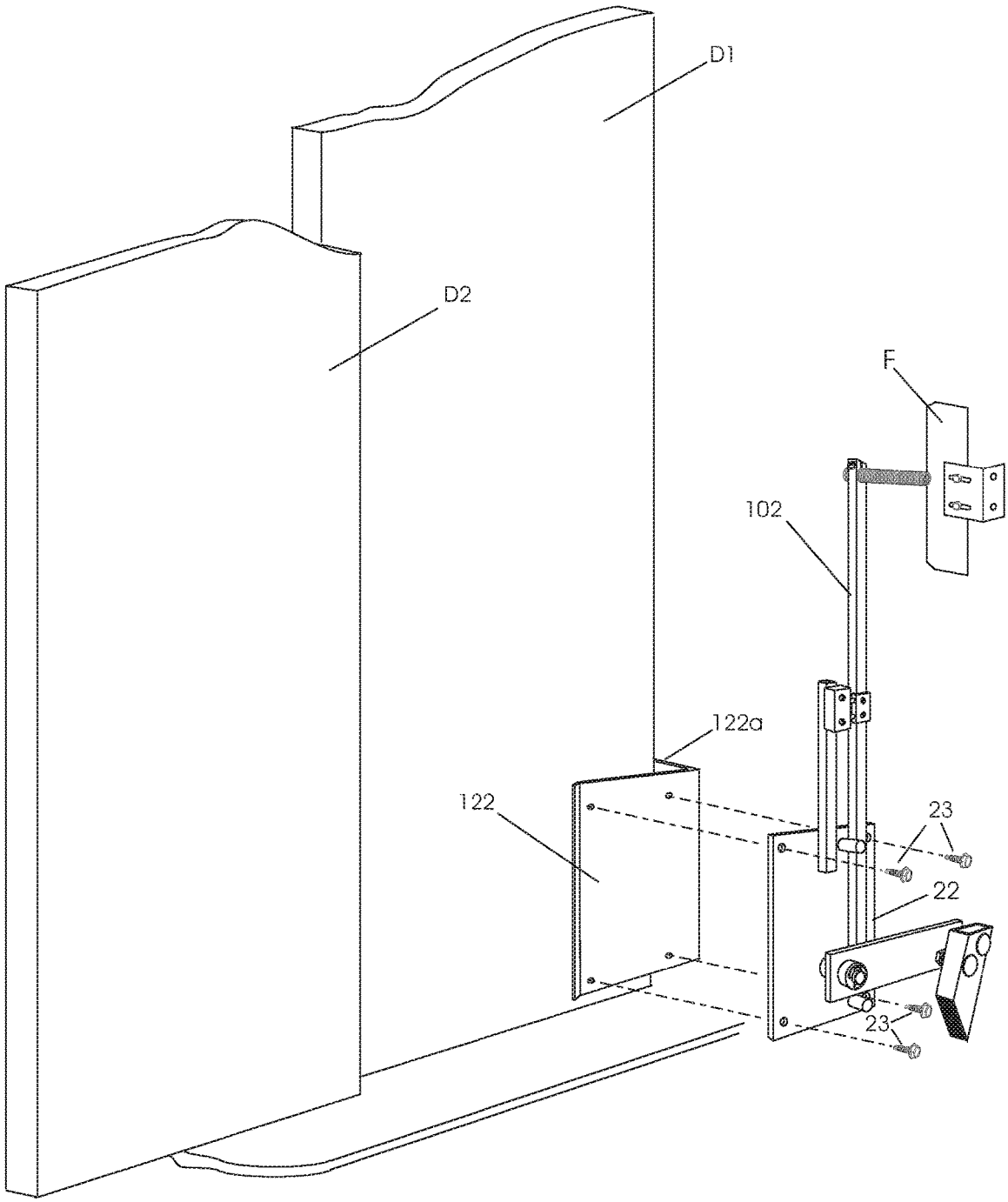
FIG. 7A shows an isometric exploded view of the alternate embodiment in FIG. 7 wherein multispeed doors D1 and D2 are in the closed position. Flag engagement arm 102 has not yet engaged flag F.
Figure 7B:
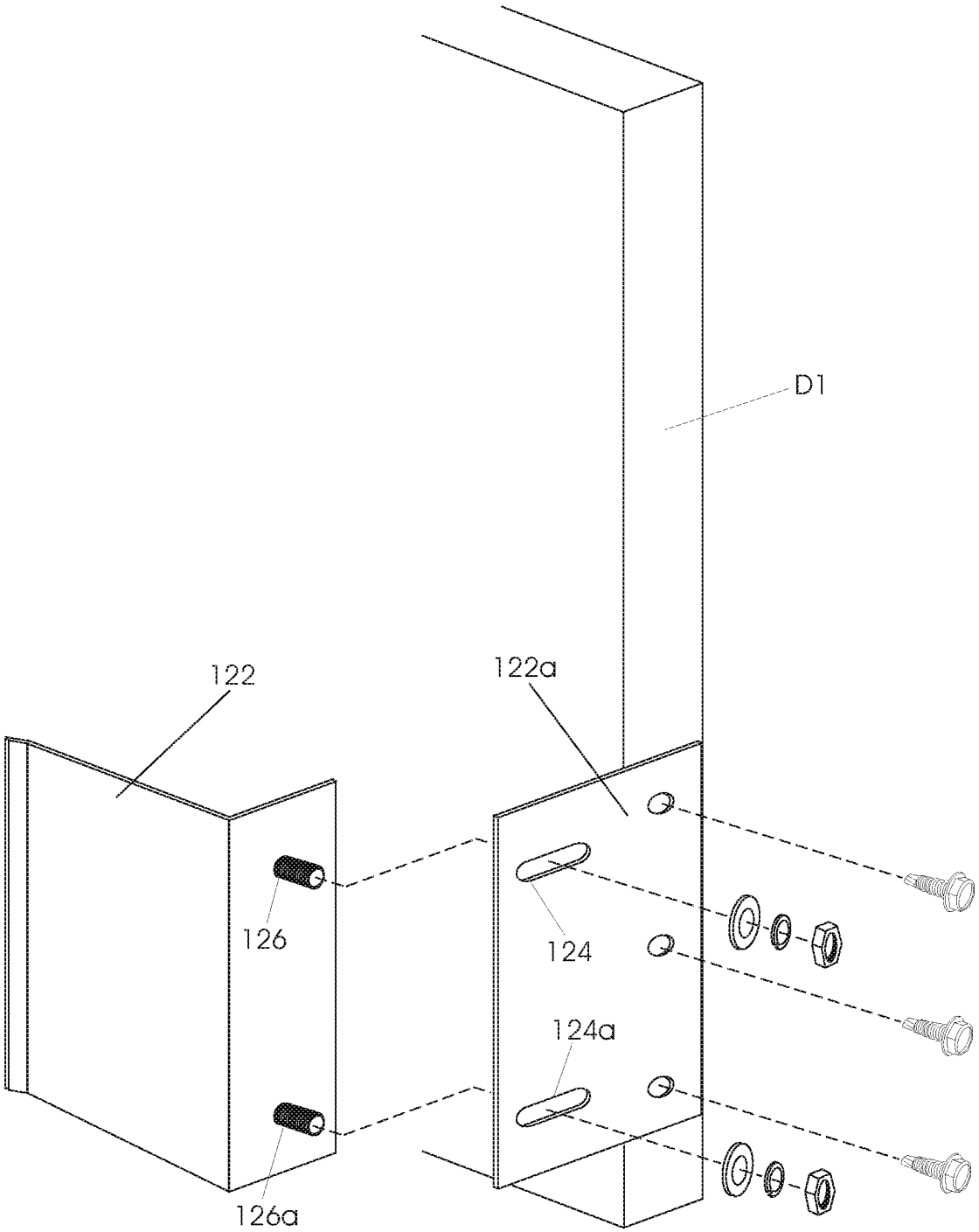
FIG. 7B represents an isometric exploded view of inner mounting plate 122 and side mounting plate 122*a*. Side mounting plate includes slots 124; 124*a* that permit a user to selectively adjust the mounting of inner mounting plate 122 and side mounting plate 122*a* depending on the dimensions of the elevator car doors. Fastening members 126; 126*a* are used to secure both mounting plates together.
Figure 7C:
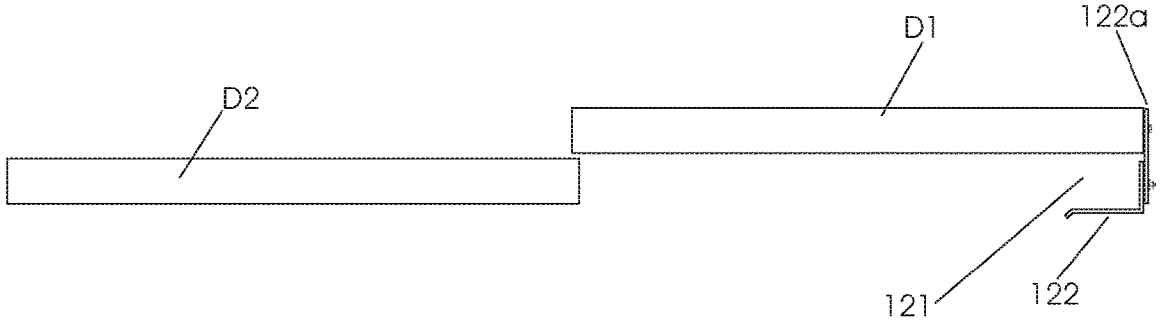
FIG. 7C shows a top view of the alternate embodiment in FIGS. 7-7B wherein doors D1 and D2 are in the closed position and the configuration of inner mounting plate 122 and side mounting plate 122*a* is shown creating a predetermined cavity 121 to receive door D2.
Figure 7D:
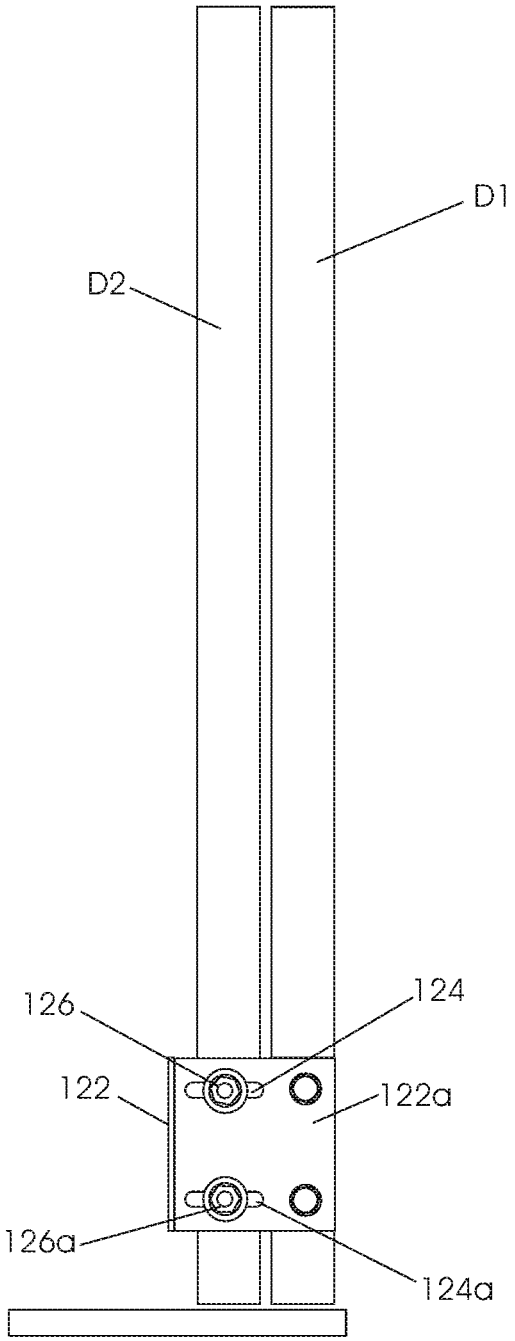
FIG. 7D is a front view of side mounting plate 122*a* wherein elevator car doors are in the closed position and elevator door D2 can be seen retracted to be substantially parallel to elevator door D1. Cavity 121 (not shown) is of a predetermined dimension based on the mounting location along slots 124; 124*a* that cooperates with the width of elevator door D2.
Figure 8:
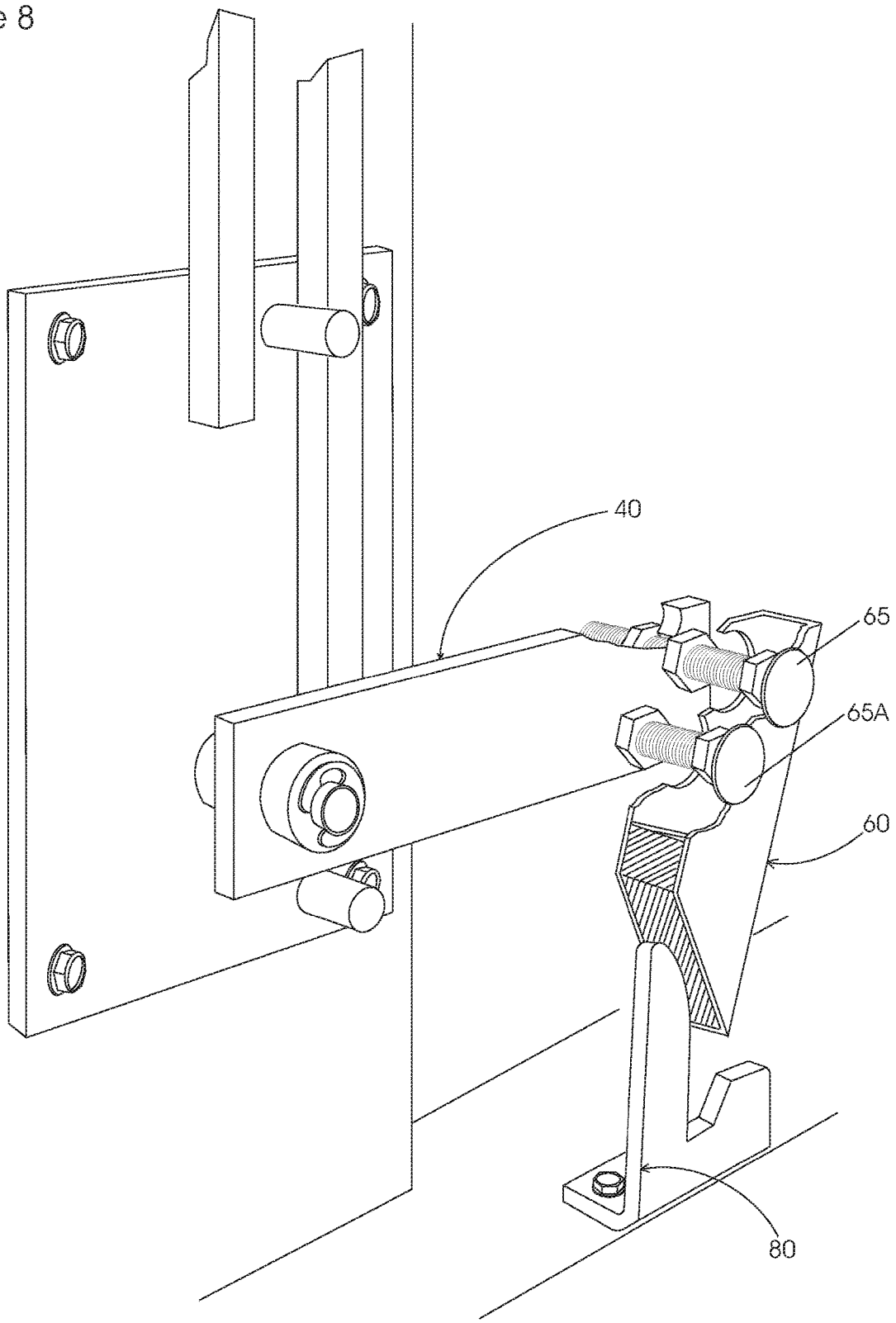
FIG. 8 is an enlarged isometric view of a cross-section of a previously described alternate embodiment showing sill distance adjustment members 65 and 65*a* fastened to lever arm assembly 40 using bolts.
Figure 9:
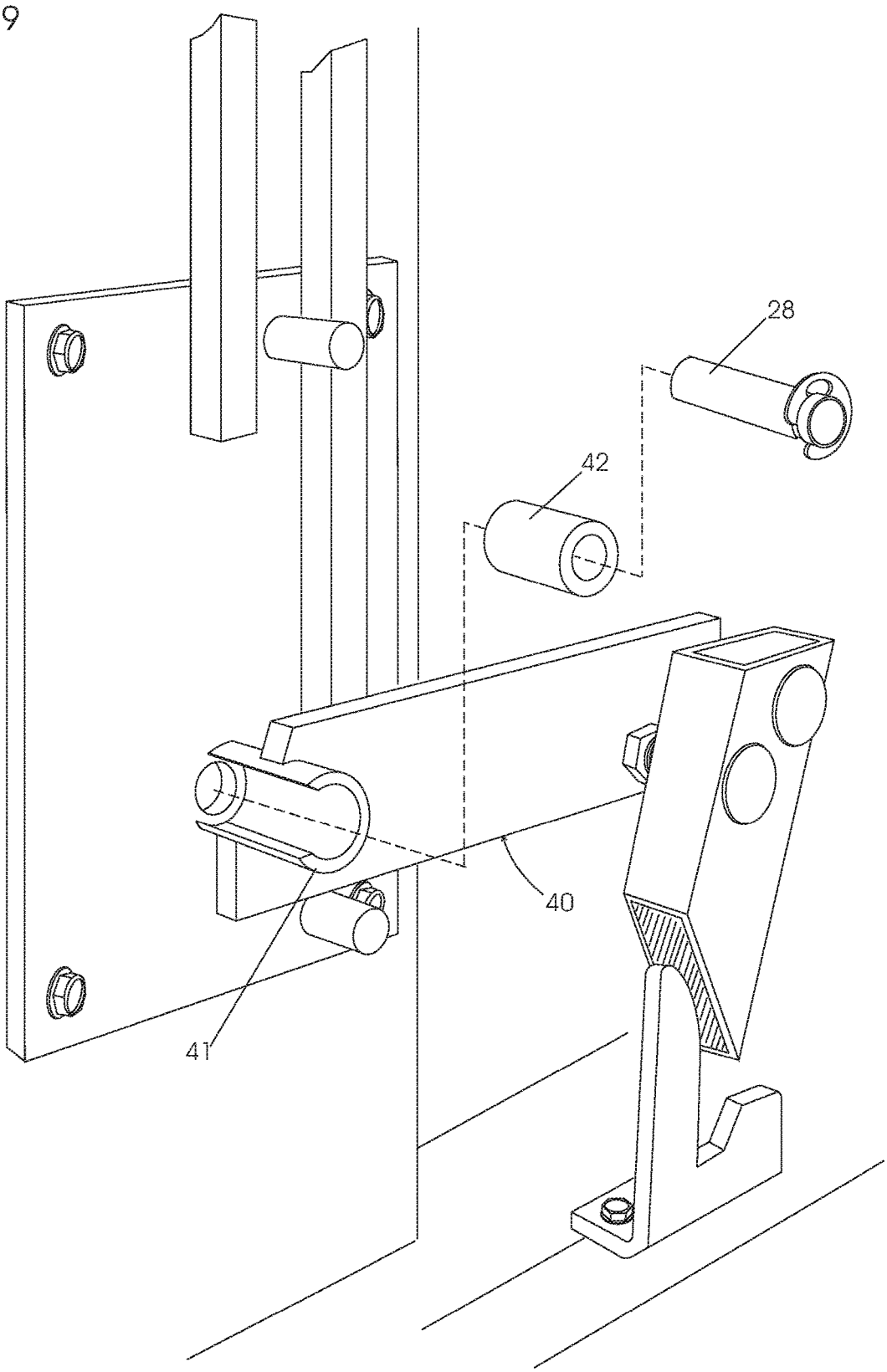
FIG. 9 is isometric view of lever arm assembly 40 showing throughhole 41 wherein sleeve bearing 42 is inserted, which houses shaft 28.
Figure 10:
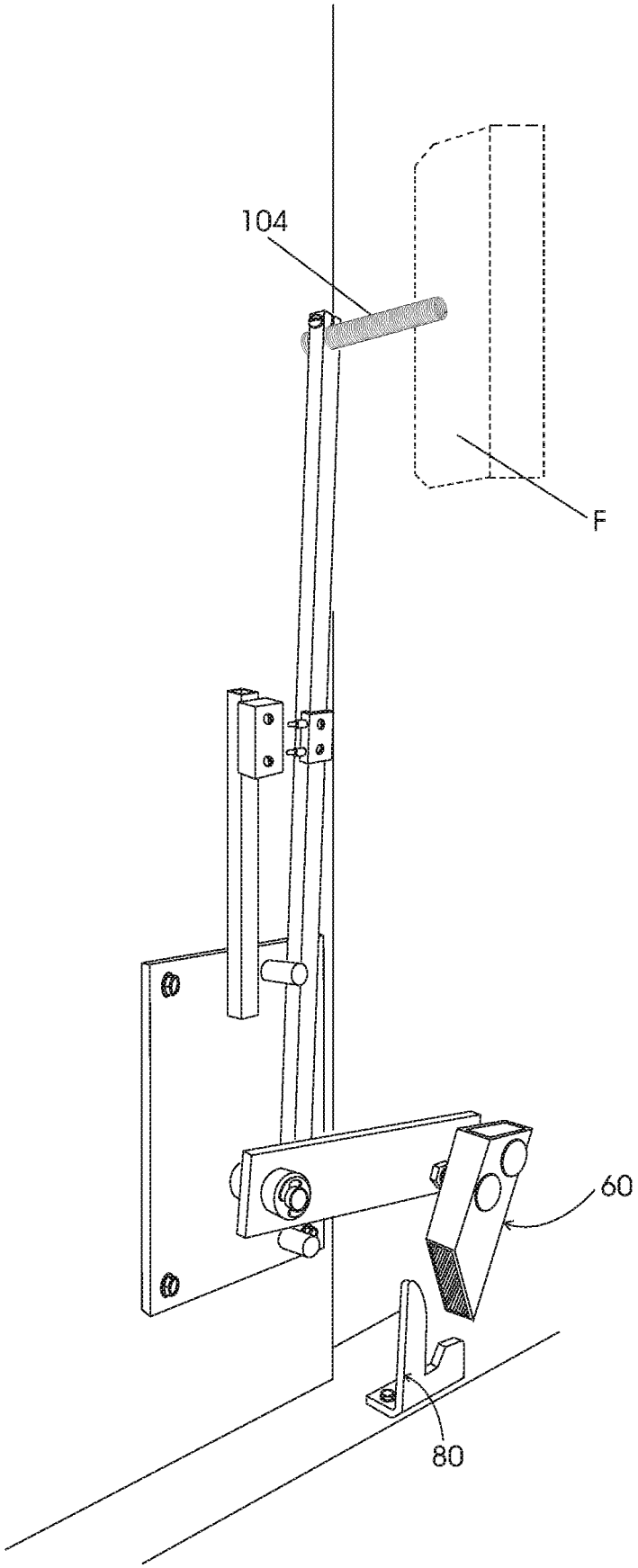
FIG. 10 represents an isometric view of the present invention wherein the elevator car is in the unlocking zone and flag engagement member 104 has engaged flag F and hook assembly 60 has cleared locking assembly 80, thereby permitting the elevator car doors to fully open.
Figure 11:
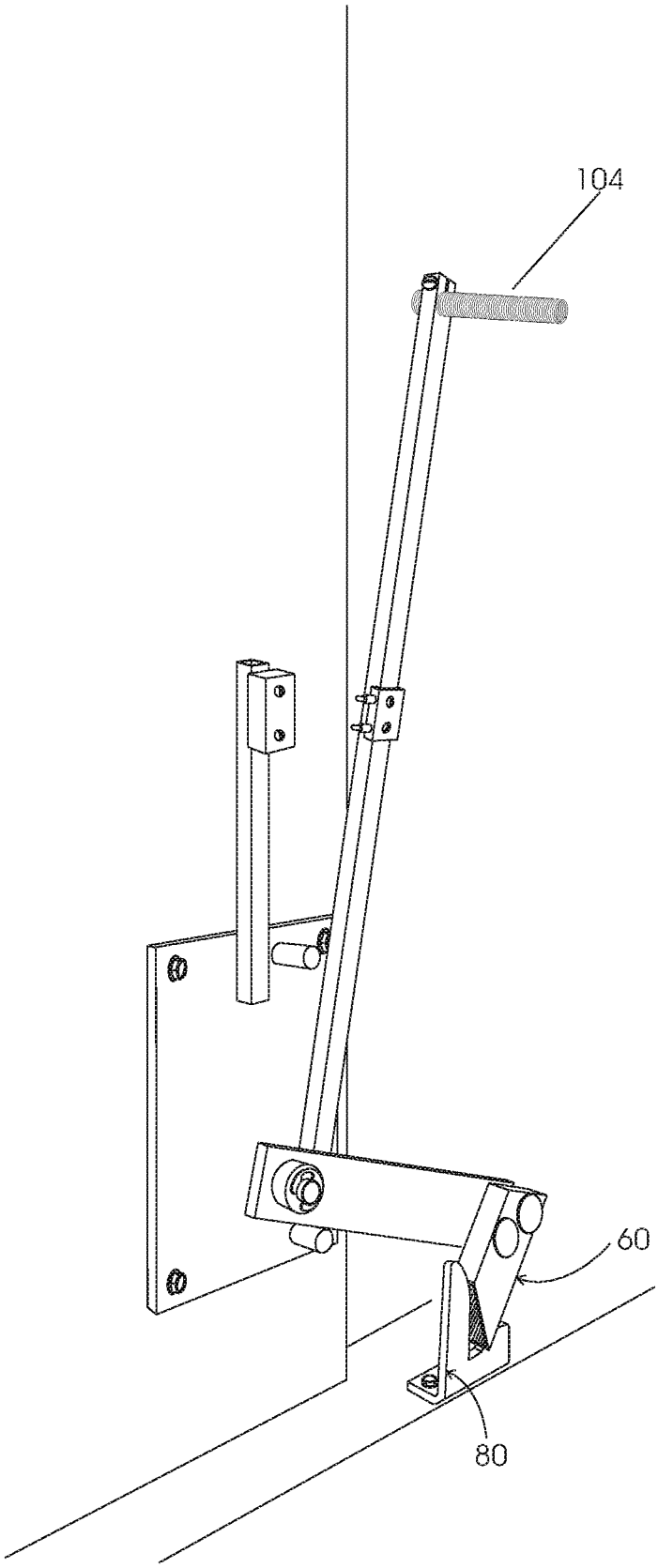
FIG. 11 represents an isometric view of the present invention wherein flag engagement member 104 has not engaged flag F and hook assembly 60 has been lodged into locking assembly 80, thereby keeping the elevator car door locked.
Figure 12A:
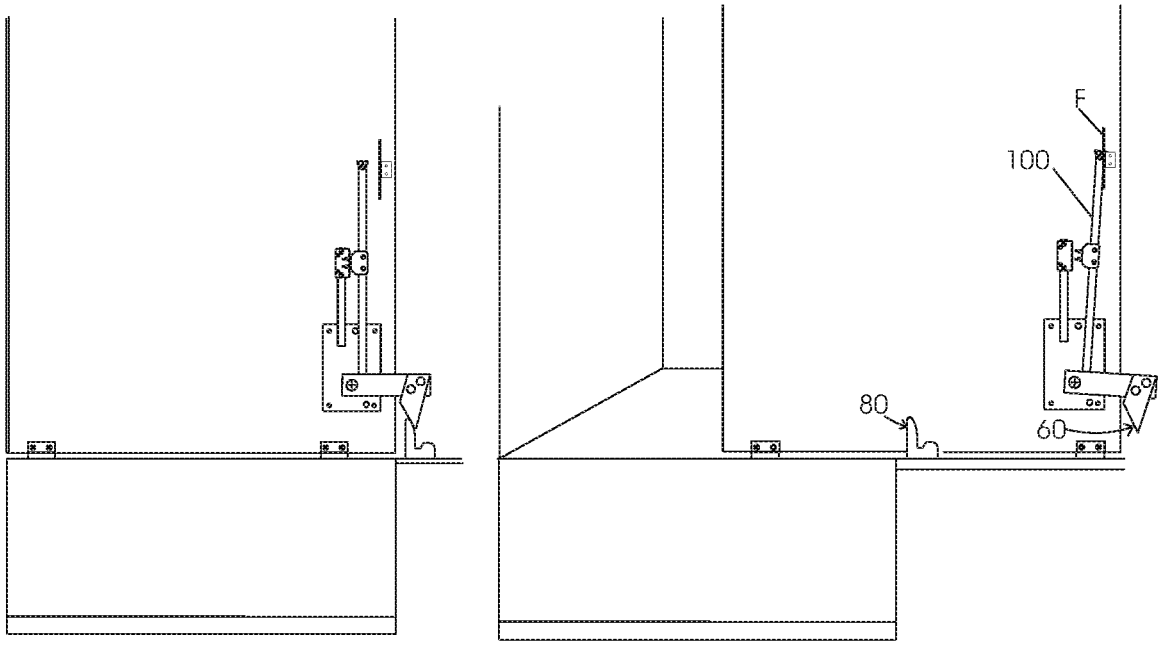
FIG. 12A is a representation of the present invention mounted to the elevator car door as the elevator doors are opened in the unlocking zone. Flag engagement assembly 100 can be seen coming into contact with flag F, thereby keeping hook assembly 60 raised at a height necessary to clear locking assembly 80, thereby allowing the elevator car door to open.
Figure 12B:
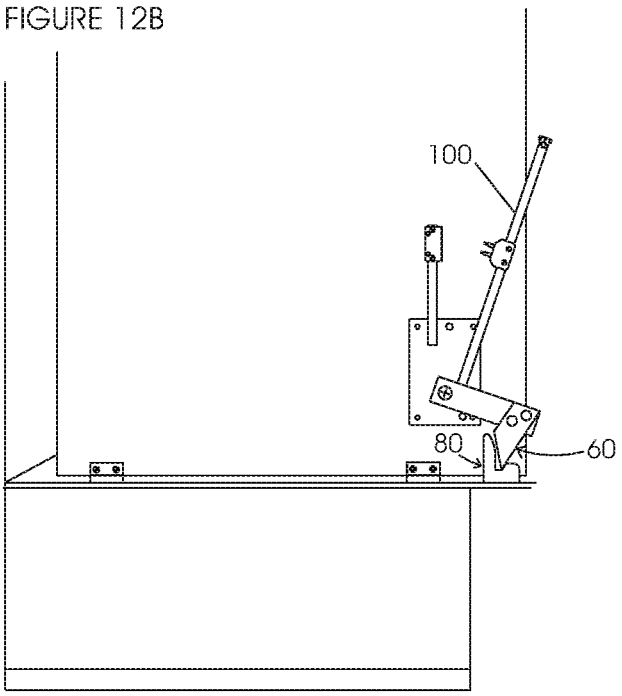
FIG. 12B is a representation of the present invention mounted to the elevator car door as the elevator doors are opened in the locking zone. Flag engagement assembly 100 does not contact a flag F therefore hook assembly 60 is permitted to be lodged into locking assembly 80.
Figure 13:
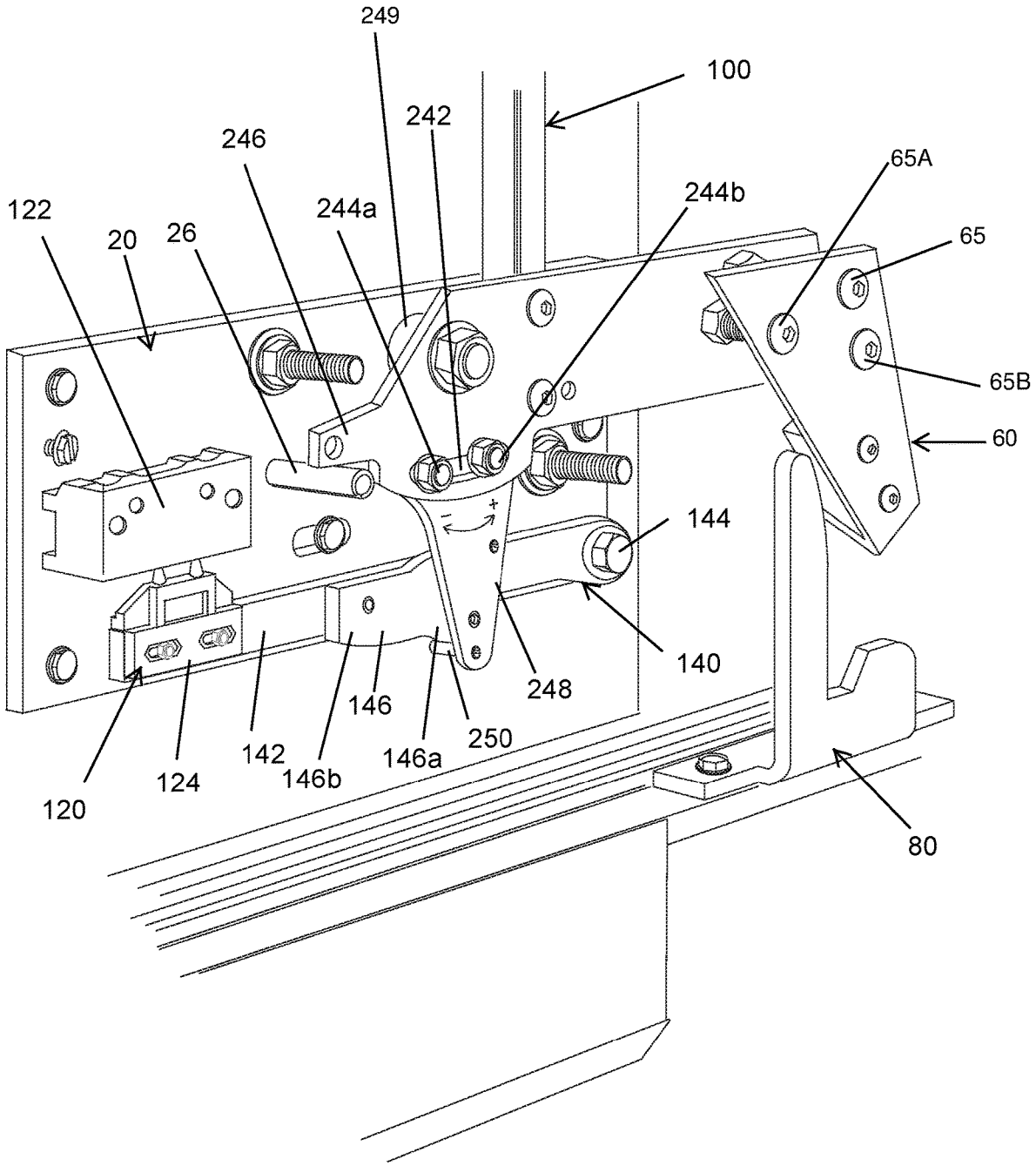
FIG. 13 shows an enlarged isometric view of the present invention in the unlocked position and switch assembly 120 in the engaged position thereby activating the elevator's drive train.
Figure 13A:
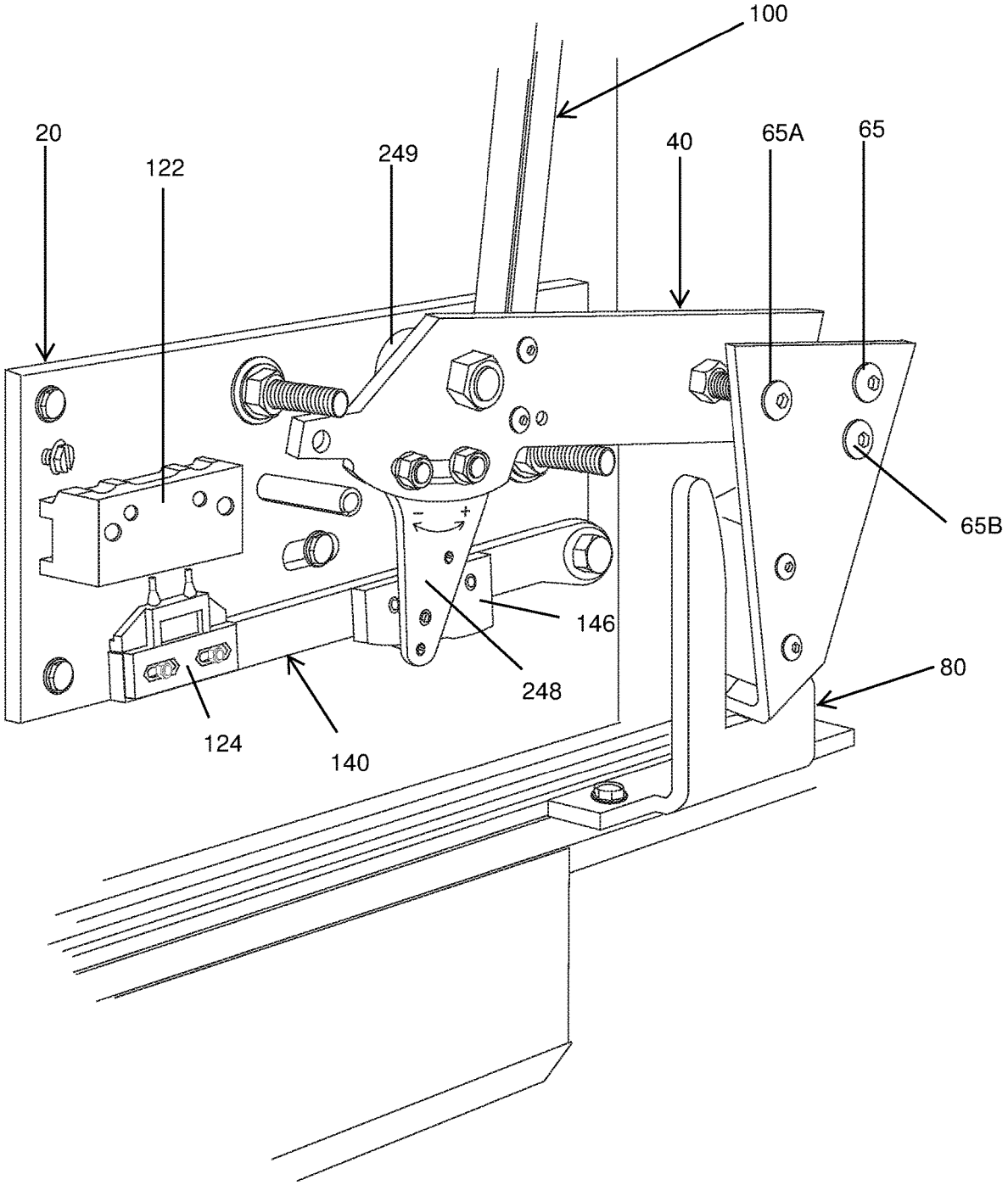
FIG. 13A shows an enlarged isometric view of the present invention in the locked position and switch assembly 120 disengaged thereby deactivating the elevator's drive train.
Figure 14:
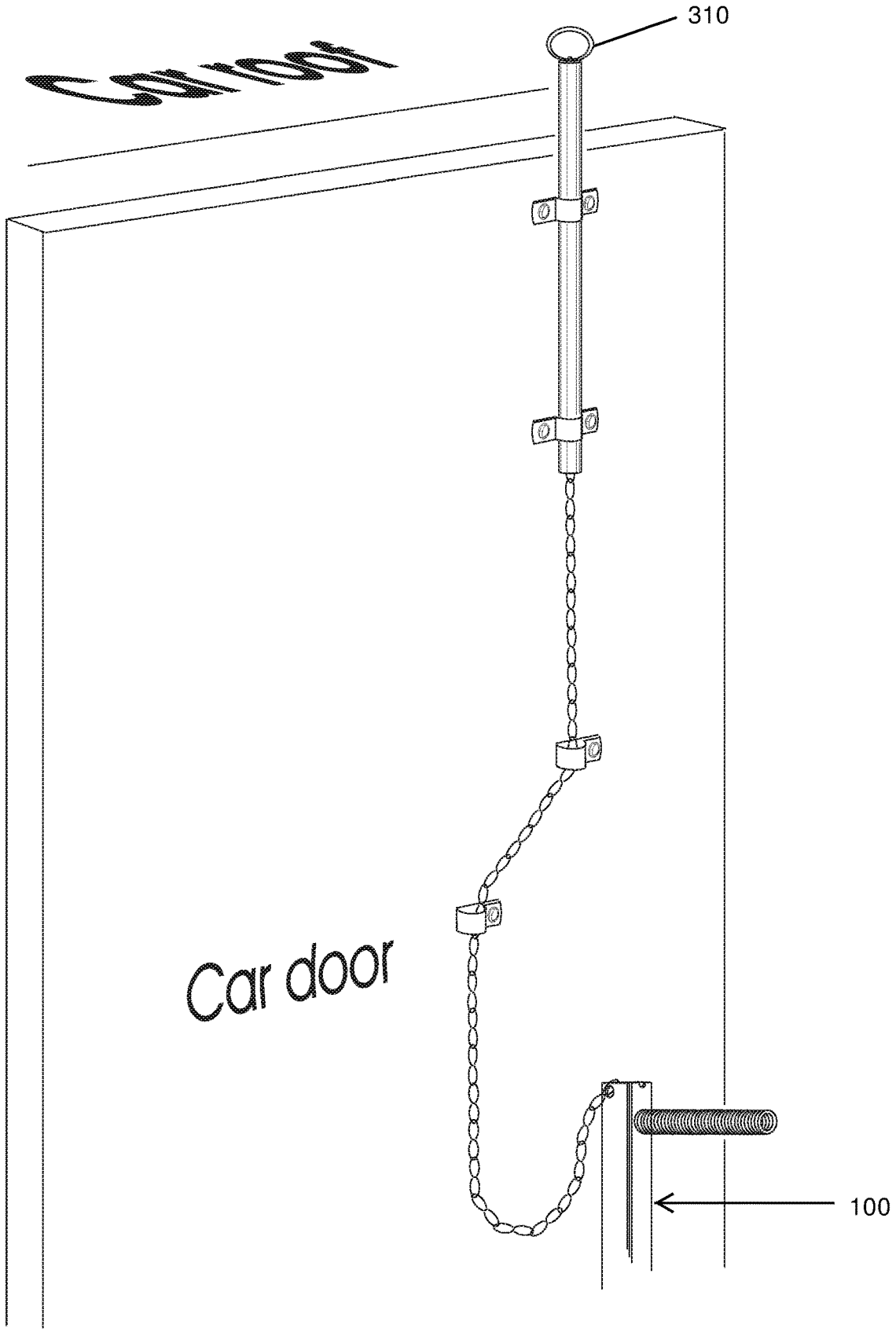
FIG. 14 shows a partial isometric view of the present invention mounted onto an elevator car door wherein manual release assembly 300 is shown.
Figure 15A:
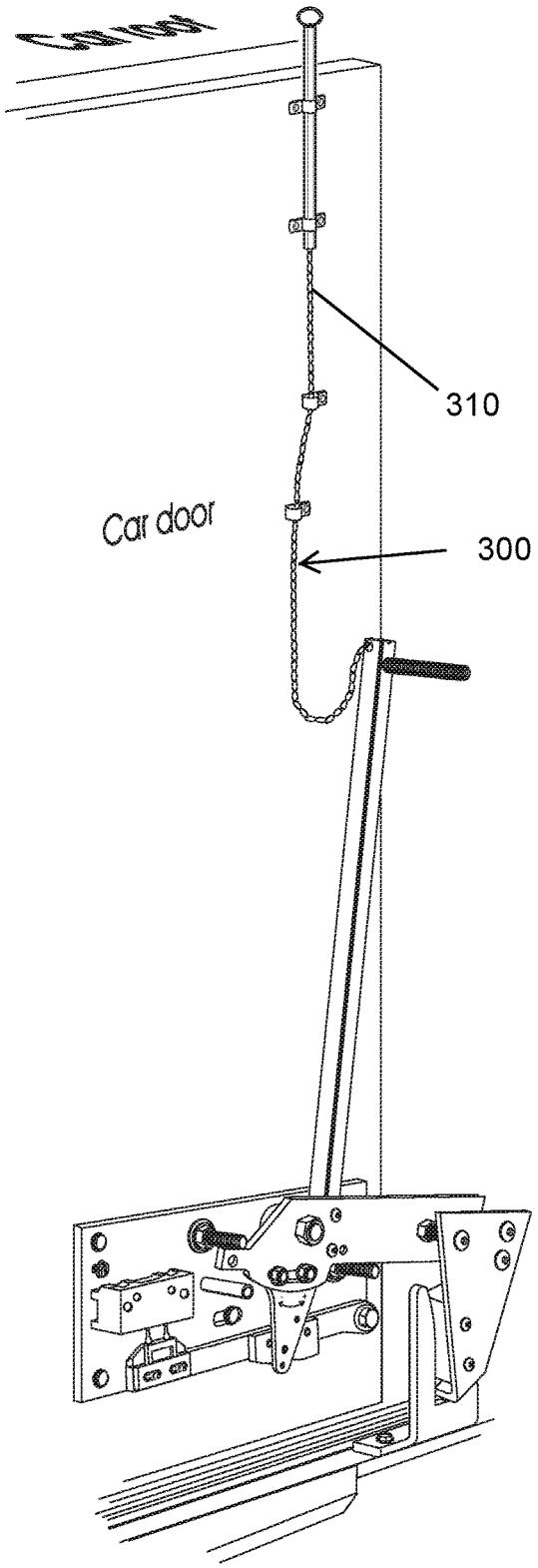
FIG. 15A illustrates an isometric view of the present invention in the locked position with flag engagement assembly 100 inclined without coming into contact with a flag F.
Figure 15B:
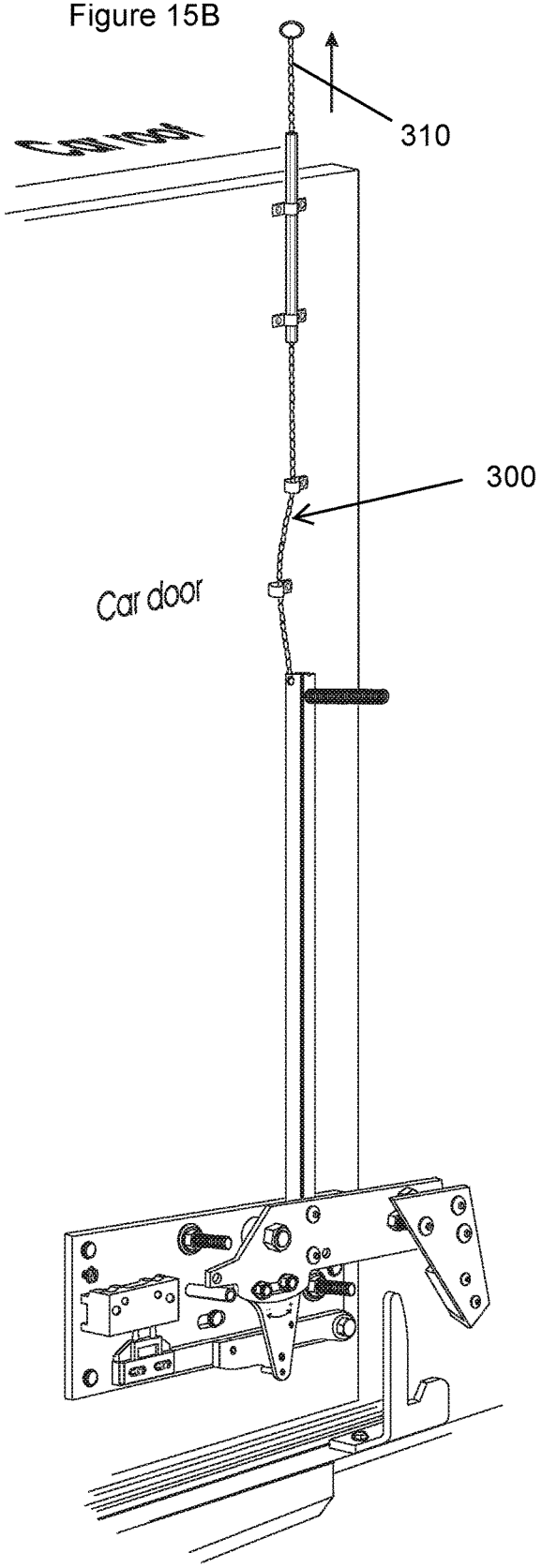
FIG. 15B is an isometric view of the present invention wherein chain member 310 of manual release assembly 300 is pulled upwards thereby urging flag engagement assembly 100 to remain in the substantially vertical position preventing hook assembly 60 from entering locking assembly 80. This view shows a user such as an emergency personnel manually keeping the present invention in the unlocked position with or without the presence of flag F.
Figure 16:
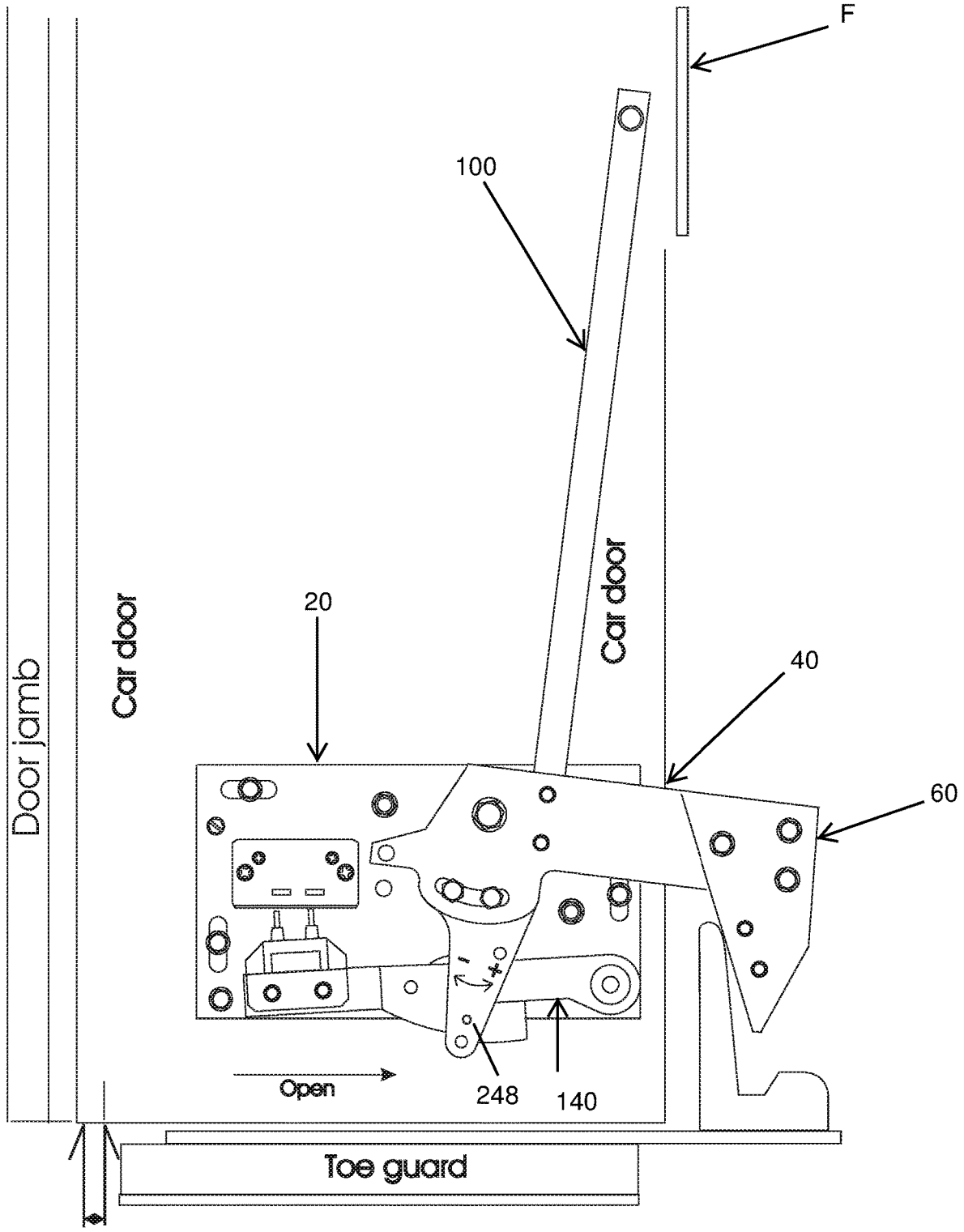
FIG. 16 shows a front elevational view of the present invention wherein flag engagement assembly 100 is seen rotating towards flag F that will stop the rotation and not allow hook assembly 60 to be locked. However, switch assembly 120 is disconnected so that the elevator does not operate as the elevator doors are permitted to open.
Figure 17A:
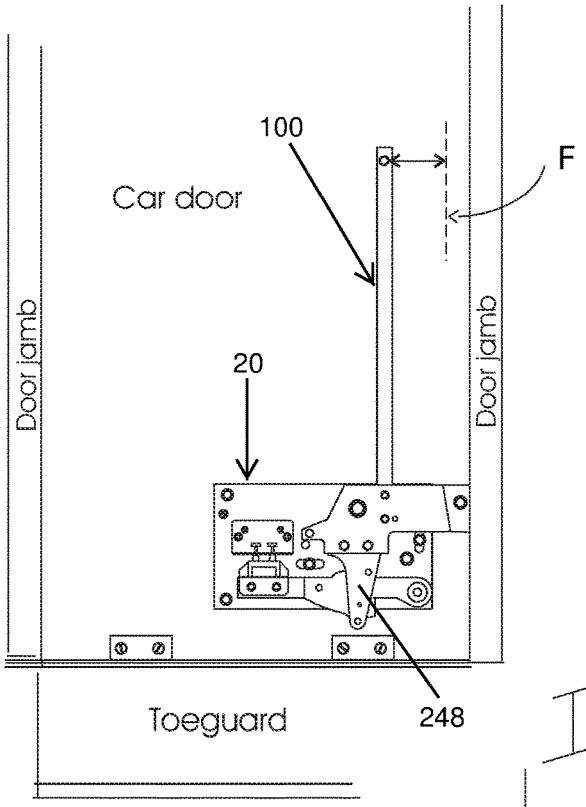
FIG. 17A represents a front elevational view of the present invention showing its location with respect to the door jamb and flag F.
Figure 17B:
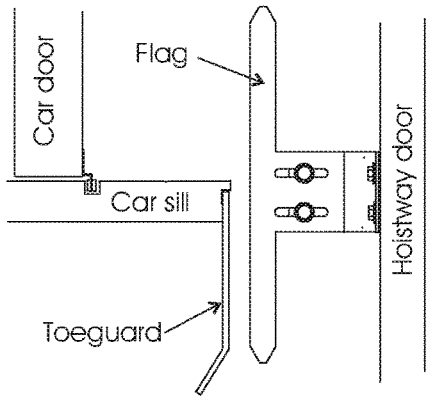
FIG. 17B shows a front elevational view of the car sill adjacent to flag F that is mounted on a hoistway door.
Figure 17C:
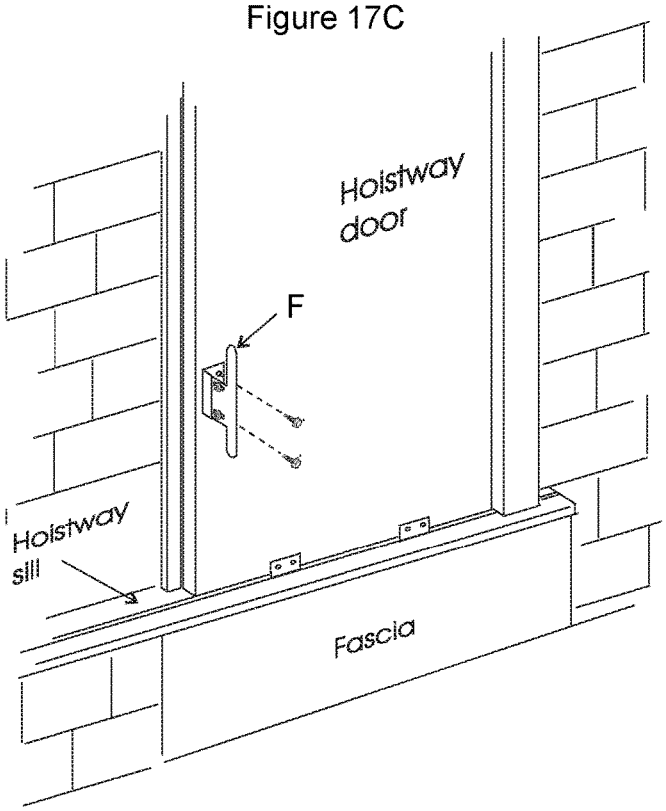
FIG. 17C is an isometric view of the operating environment of a hoistway showing where flag F can be mounted along a hoistway door that cooperates with flag engagement assembly 100 (not shown).
Figure 18:
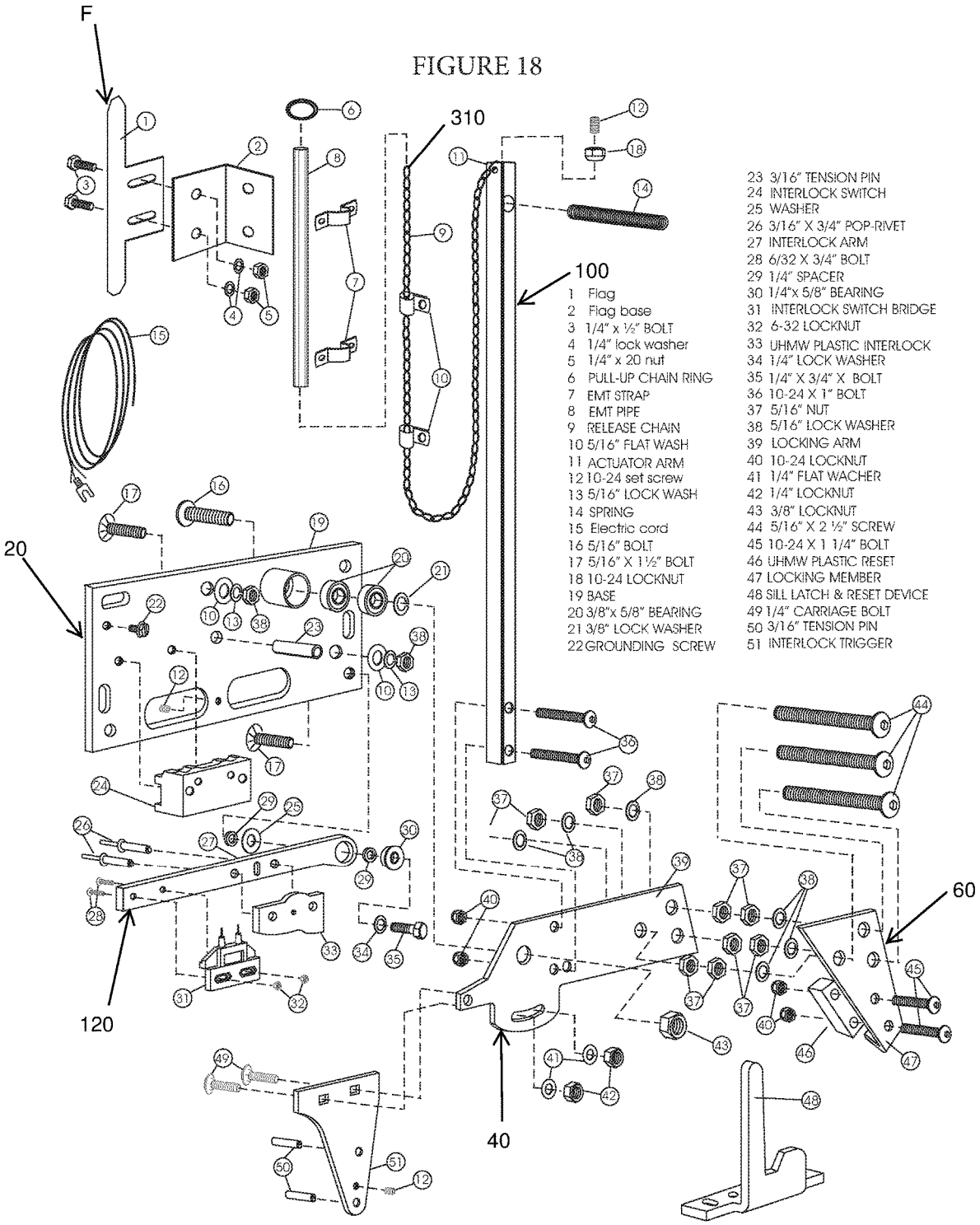
FIG. 18 shows an exploded view of the present invention showing its components.

As seen in FIG. 2, mounting assembly 20 also includes bottom stopper pin 26 mounted to mounting plate 22 at a height that prevents hook assembly 60 from rotating freely and becoming a nuisance if the door needs to be removed or opened for emergencies or maintenance. In an alternate embodiment, bottom stopper pin 26 can be used to prevent hook assembly 60 from dragging across the sill after clearing locking assembly 80. In an alternate embodiment, shown in FIG. 6, roller 200 can be used instead of bottom stopper pin 26 to prevent hook assembly 60 from dragging across the sill. In an alternate embodiment, seen in FIG. 2, shaft 28 can be passed through sleeve bearing 42 to reduce friction, and thus wear and tear, as lever arm 46 rotates. Shaft 28 is inserted through throughholes 41 of lever 46, shown in FIG. 9. Sleeve bearing 42 encases shaft 28 within throughholes 41. Sleeve bearing 42 reduces the friction between shaft 28 and lever 46 as lever arm assembly 40 rotates.

Generally, elevator car doors include bumpers or astragals to prevent noise created by the closing door against the strike jamb, if a single-slide or multi-speed door. These bumpers or astragals are also used to limit the noise in center opening doors. In the event that the bumpers or astragals become defective, the elevator car doors close more than they usually would. Top stopper pin 24 accounts for this breakdown possibility and is mounted to mounting plate 20 at a predetermined position so that even if car doors close more than usual, the reset function of hook assembly 60 is unaffected. Top stopper pin 24 is maintained slightly separated from flag engagement arm 102 in the traveling or reset position to account for the possibility of this extra range of motion (due to bumper or astragal failure).

As shown in FIG. 1, lever arm assembly 40 includes lever 46 that rotates about shaft 28. The positioning of shaft 28 and the distance of lever arm 46 have a cooperative relationship so that hook distal end 64 rests on reset portion 84 of locking assembly 80 when car door safety device 10 is in the reset position. Hook assembly 60 includes hook 62 having hook distal end 64 that rests on reset portion 84 when the car door is closed, as previously described. Hook assembly 60 further includes sill distance adjustment members 65; 65*a* that are adjusted to outwardly extend hook 62 to accommodate the distance between lever arm 46 and the positioning of locking assembly 80 on the elevator sill. In an alternate embodiment, seen in FIG. 2, pad 66 can be mounted to hook distal end 64 to reduce the coefficient of friction between hook 62 and reset portion 84.

Figure 3:
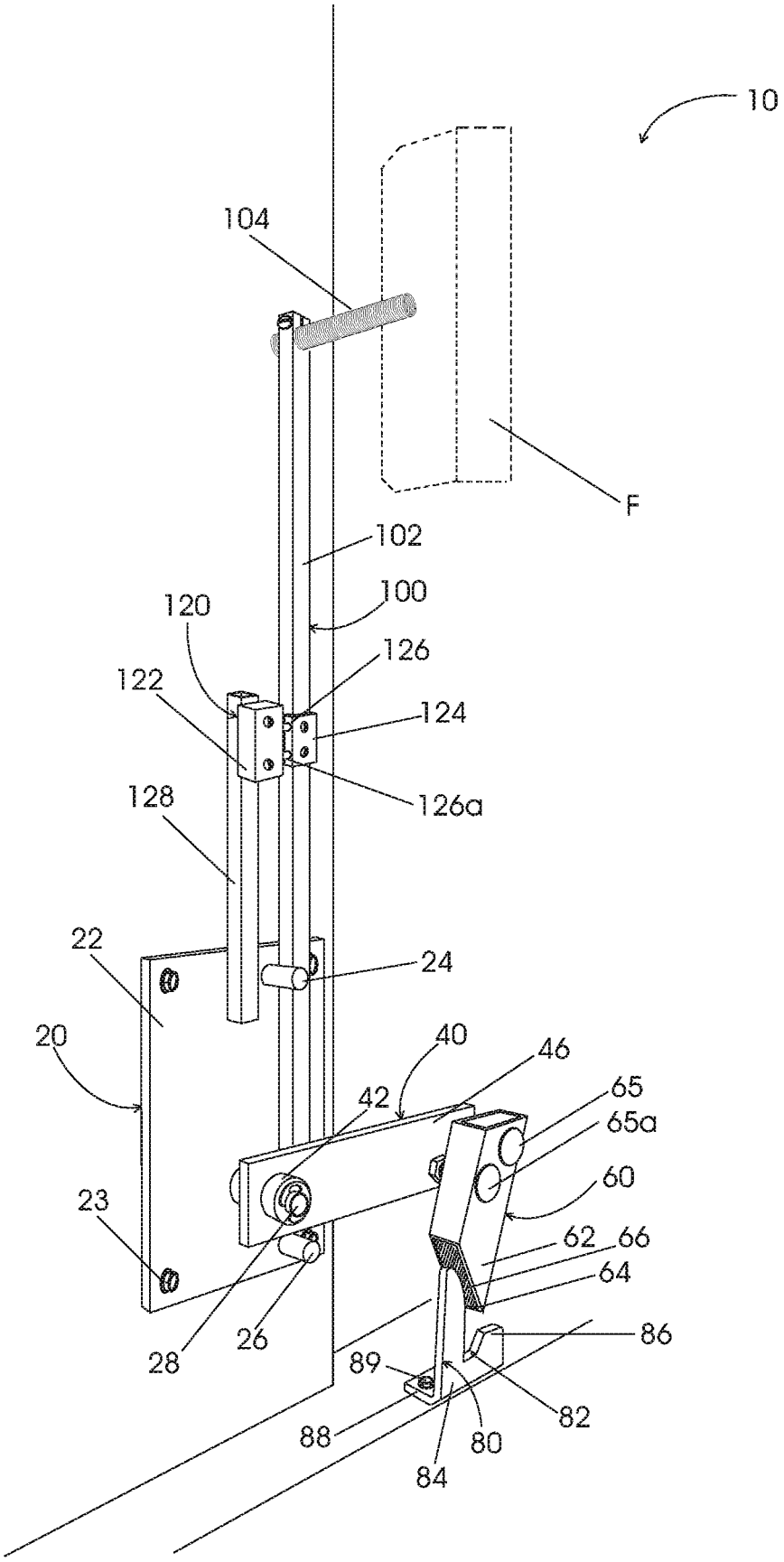
FIG. 3 is an isometric view of another alternate embodiment wherein electric switch assembly 120 is used to disconnect an elevator's driving means when flag engagement arm 102 falls forward as the door begins to open.
Figure 3A:
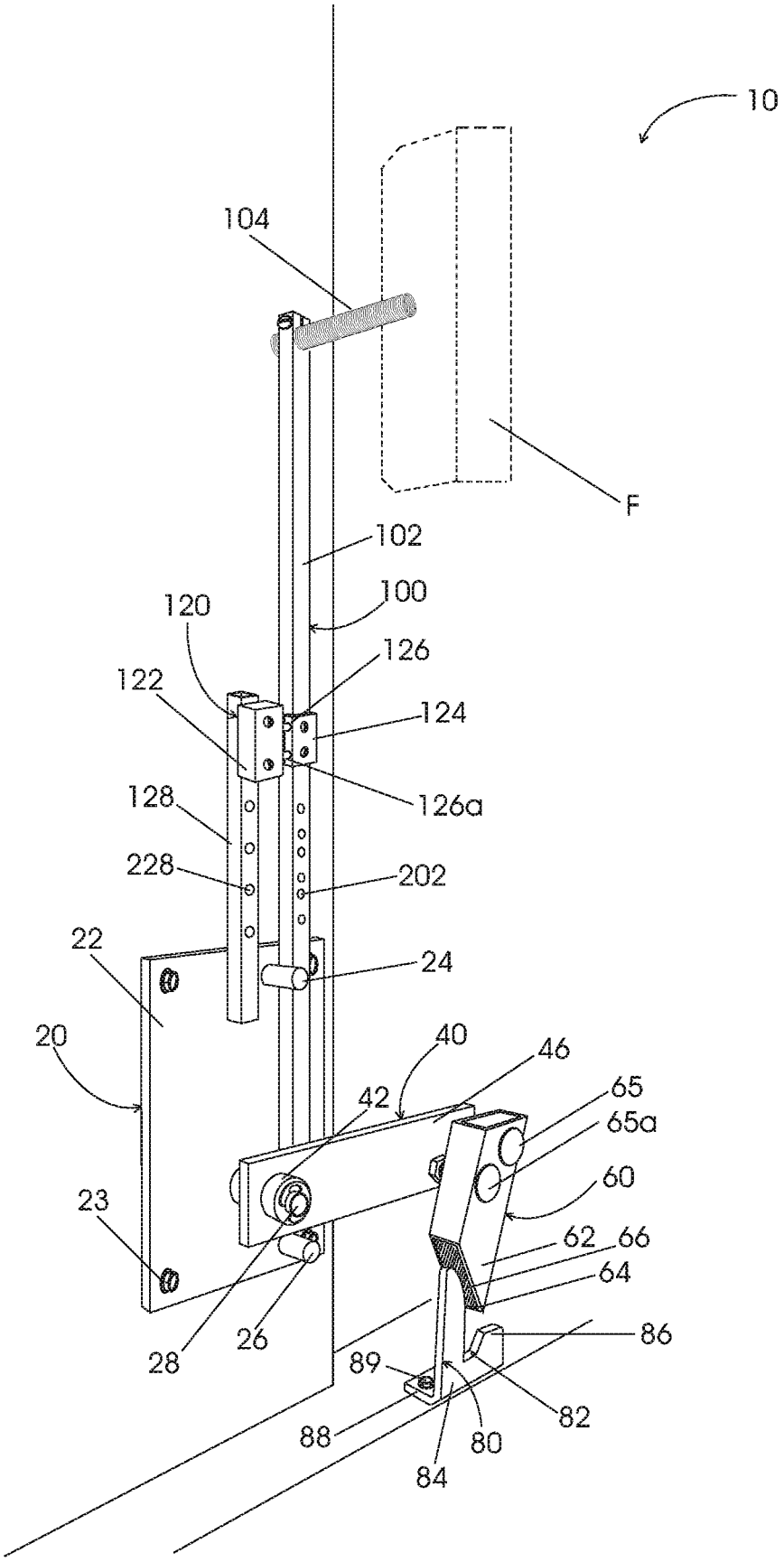
FIG. 3A is an isometric view of an alternate embodiment wherein switch arm 128 includes a plurality of female switch throughholes 228 to adjust the position of female switch member 122. Flag engagement arm 102 includes male switch throughholes 202 used to adjust the position of male switch member 124 to cooperate with female switch member 122.
Figure 4:
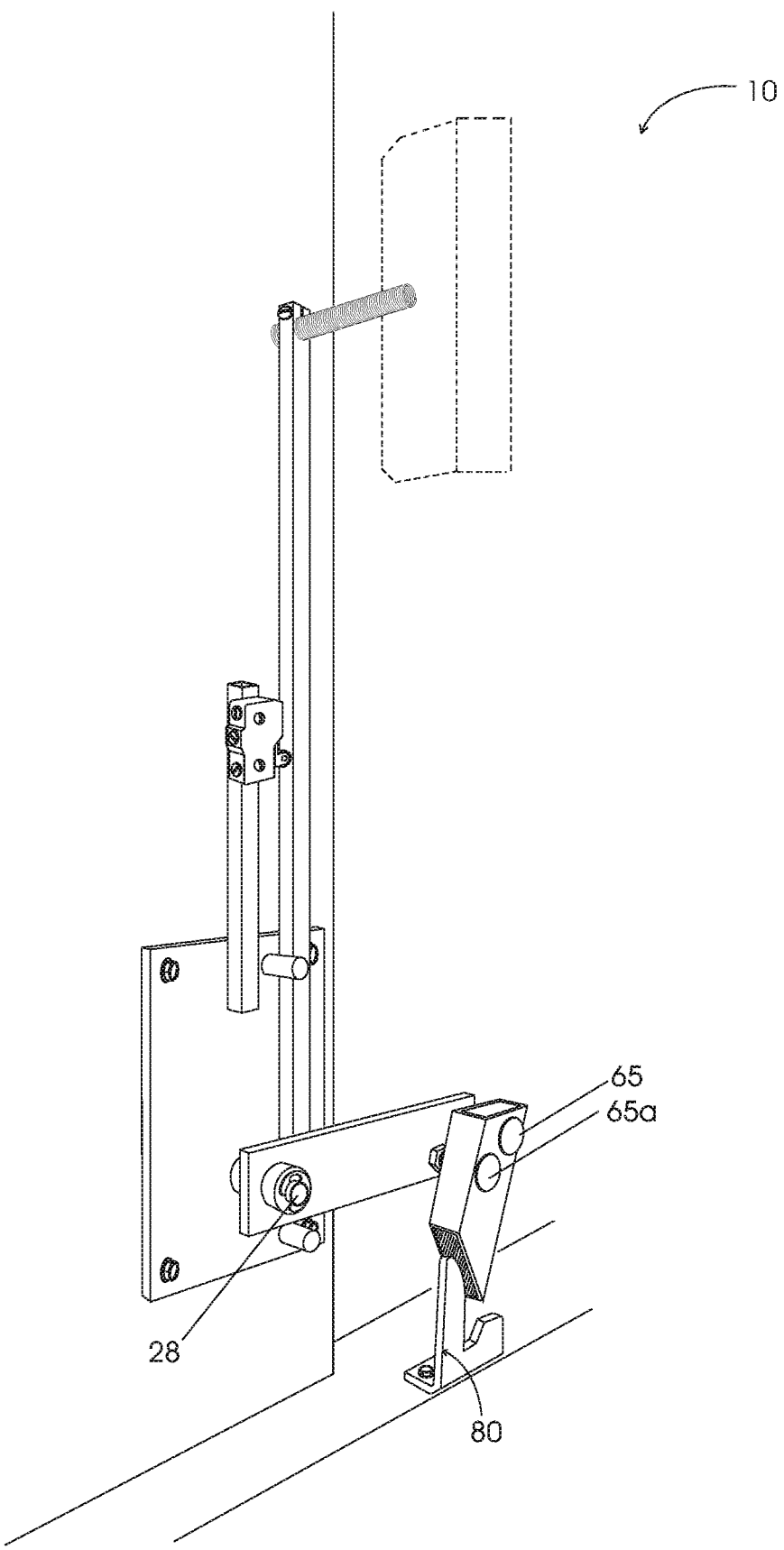
FIG. 4 is an isometric view of another alternate embodiment having a different type of switch. Also shown is an alternate embodiment when sill adjustment members 65; 65*a* are used to cooperate with shaft 28, allowing hook assembly to be positioned at predetermined distances to cooperate with locking assembly 80.
Figure 5:
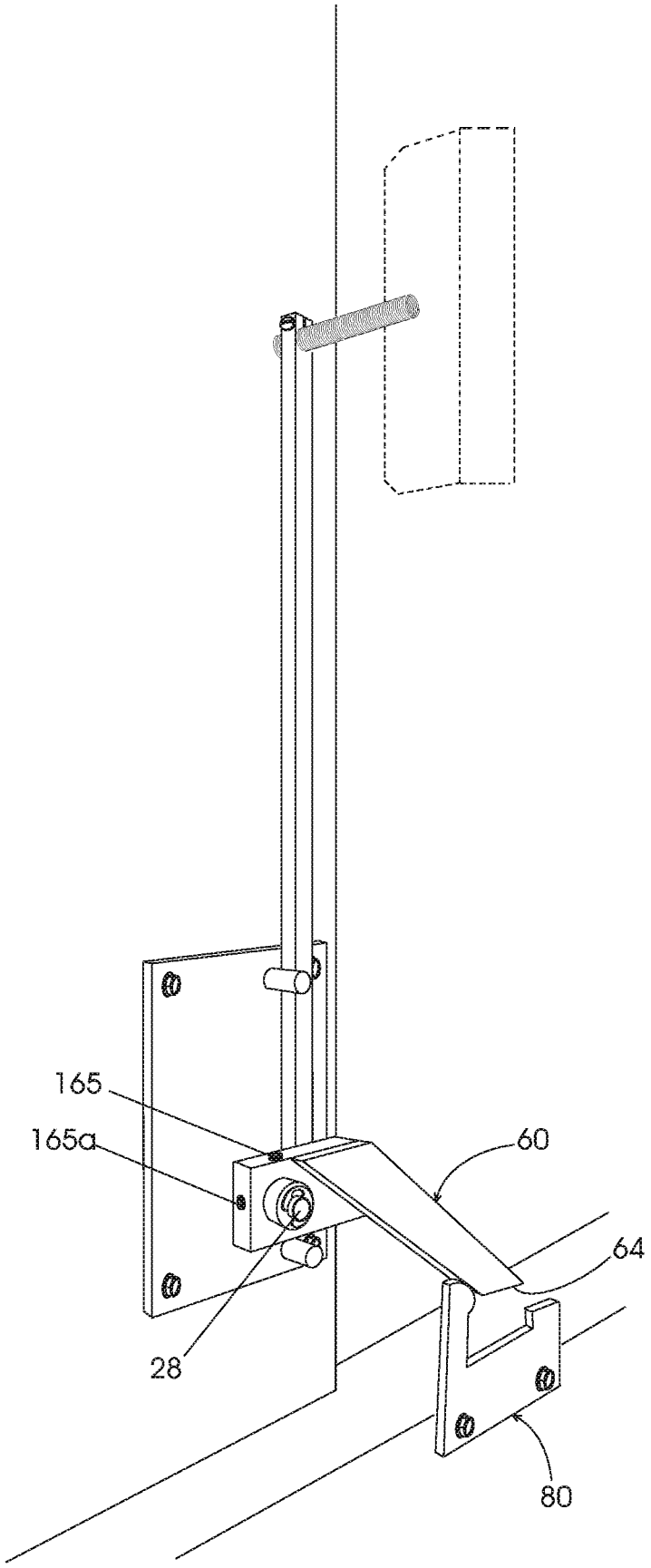
FIG. 5 represents an isometric view of another alternate embodiment for hook assembly 60 having a smaller slope at hook distal end 64 and still being able to cooperate with locking assembly 80, thereby reducing the distance hook assembly 60 has to travel before being locked against locking assembly 80 reducing distance elevator doors are allowed to open before being locked.

As shown in FIG. 3, locking assembly 80 includes locking cavity 82 that receives hook 62 as it falls forward into the locking position. Locking assembly 80 also includes reset portion 84 upon which hook 62 rests. Reset portion 84 has a sloping gradient that cooperates with the angle of hook distal end 64 to allow hook 62 to slide down when locking and slide up when resetting. The distance between where hook rests on reset portion 84 and locking cavity 82 defines the amount the elevator car door is permitted to open before being restricted. As shown in FIG. 3, locking assembly 80 also includes locking portion 86 that is kept spaced apart from reset portion 84 by locking cavity 82. Locking cavity 82 is predetermined to be a depth between reset portion 84 and locking portion 86 sufficient to allow enough of hook 62 to come in abutment with locking portion 86 that the opening movement of the car elevator door is restricted.

As shown in FIG. 3, flag engagement assembly 100 includes flag engagement arm 102 that is rigidly and perpendicularly mounted to lever arm 46. Flag engagement assembly 100 also includes flag engagement member 104 that comes into an abutting relationship with a flag F. When the elevator door is attempted to be opened, hook 62 begins to slide down reset portion 84. Flag engagement arm 102 is positioned at a predetermined location on lever arm 46 so that when flag engagement member 104 engages a flag F, lever arm 46 is prevented from rotating further, thereby preventing hook 62 from being lodged into locking cavity 82. The elevator door is then allowed to be opened as hook assembly 60 clears locking assembly 80. The over rotation of lever arm 46 is then stopped by bottom stopper pin 26 preventing hook 62 from being dragged across the sill after clearing locking assembly 80. If no flag F is present, flag engagement member 104 continues to fall forward, lever arm 46 continues to rotate urging hook 62 to become journaled between reset portion 84 and locking portion 86 within locking cavity 82, thereby preventing the elevator door from opening any further. Locking assembly 80 is mounted to the elevator sill using anchoring plate 88, having fastening means 89. Fastening means 89 can include bolts, screws, inserts, welding or other similar methods that can achieve the mounting purpose.

When the elevator doors begin closing car door safety device 10 begins resetting itself. Upon closing, hook 62 begins sliding up the slope of reset portion 84 until flag engagement arm 102 is in a substantially vertical position. Top stopper pin 24 is used to prevent the over rotation of hook 62 over locking assembly 80.

In an alternate embodiment, electric switch assembly 120 can be used to deactivate the elevator's driving means when the car door is opened. Electric switch assembly 120 includes female switch portion 122 rigidly mounted to switch arm 128 as shown in FIG. 3. Electric switch assembly 120 also includes male switch portion 124 that is rigidly mounted at a cooperative height along flag engagement arm 102. Electric switch assembly 120 also includes circuit closing pins 126; 126*a* extending from male switch portion 124 that close or open the circuit that controls the elevator's driving means. As the elevator car doors are opening and flag engagement arm 102 rotates, male switch portion 124 mounted to flag engagement arm 102 begins to separate from female switch portion 122. This causes circuit closing pins 126; 126*a* to begin disconnecting from female switch portion 124.

In an alternate embodiment, shown in FIGS. 13-17C, the present invention can include switch lever assembly 140 mounted to mounting assembly 20. This way, switch assembly 120 is securely affixed to the present invention so that it does not inadvertently engage or disengage based on vibrations associated with the elevator traveling through the hoistway. Switch lever assembly 140 includes switch lever member 142, rotating fastening member 144, sloping member 146 mounted thereon at a predetermined location, and switch assembly 120 mounted at its distal end. Sloping member 146 includes a thicker portion 146*a* and a narrower portion 146*b*. In this embodiment, lever arm assembly 40 includes delay adjustment slot 242, delay adjustment members 244*a*; 244*b*, and lever extension 246. In this embodiment, stopper pin 26 comes in abutting engagement with lever extension 246 to prevent lever arm assembly 40 from over rotation that can cause hook member 62 to slide over and out of locking assembly 80. Lever arm assembly 40 can be mounted to mounting assembly 20 using a ball bearing 149 within a bearing housing with a shaft going through the ball bearing 149 and secured using a locknut.

Delay guiding member 248 is mounted to lever arm assembly 40 and is longitudinally disposed therefrom to a length past the bottom of sloping member 146. Delay guiding member 248 includes delay guiding pin 250 extending perpendicularly from its bottom distal end and positioned underneath and against the bottom of sloping member 146. In the present invention's unlocked position, delay guiding pin 250 is positioned underneath thicker portion 146*a*.

As the elevator door is opened, lever arm assembly 40 is rotated towards locking assembly 80 and as it rotates, delay guiding member 248 and its associated delay guiding pin 250 are urged along thicker portion 146*a* towards narrower portion 146*b*. When delay guiding pin 250 slides into narrower portion 146*b*, switch lever 142 is able to drop thereby disengaging male switch member 124 from female switch member 122 and deactivate the elevator's drive train. Thus, when the elevator car door is opened, the driving means are deactivated for safety. The amount that the door is allowed to open before switch assembly 120 is deactivated is a function of the distance that delay guiding member 250 has to travel along thicker portion 146*a* before being underneath narrower portion 146*b*. In this embodiment, an additional adjustment member 65B is used with hook 62 to make it more secure and cancel torqueing that hook 62 would receive.

To adjust this delay, delay adjustment members 244*a*; 244*b* can be loosened to allow a user to change the angle of delay guiding member 248. If delay guiding member 248 is tilted towards narrower portion 146*b* then the delay is reduced thereby reducing the amount the elevator door is allowed to open before the dive train is disconnected. Inversely, if delay guiding member 248 is tilted away from narrower portion 146*b* then the elevator car doors can be opened wider before the elevator's drive train is deactivated. This function of delaying the deactivation of the drive train as the elevator car door opens is done irrespective of the presence of a flag F.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A car door safety device comprising a mounting assembly, a lever assembly having a hook member mounted thereon, a flag engagement assembly extending from said lever assembly, a locking assembly, said car door safety device being in a locked position when said hook member is lodged in said locking assembly and in an unlocked position when said hook member is not lodged within said locking assembly, wherein said flag engagement assembly further includes a flag engagement arm including a flag engagement member that cooperates with a flag mounted to a hoistway door that when said flag engagement member contacts said flag, said flag engagement assembly is prevented from rotating forward and thereby prevents said hook member from being locked within a locking member of said locking assembly allowing an elevator door to open, wherein said locking assembly includes a first end larger than a second end, said hook member rests on said first end while in a reset position and is lodged between said first and second ends in said locked position, said first and second end are of a cooperative proportion that allows said hook member to clear said second end when said elevator door restrictor is in said unlocked position.

2. The car door safety device of claim 1 wherein a manual release assembly extends from said flag engagement member and includes a member that holds said flag engagement arm in a substantially vertical position when pulled.

3. The car door safety device of claim 1 wherein an electrical switch lever assembly is rotatably mounted to said mounting assembly.

4. The car door safety device of claim 1 wherein said lever assembly includes a delay adjusting slot.

5. The car door safety device of claim 1 wherein said flag engagement member is a spring member.

6. The car door safety device of claim 1 wherein a delay guiding member can be tilted to adjust a delay between the distance the elevator door is opened and the time it takes said switch assembly to deactivate.

7. The car door safety device of claim 1 wherein said hook member rests at a predetermined location on said locking assembly so that said hook member can clear said locking assembly if said flag is engaged.

8. The car door safety device of claim 1 wherein said lever assembly includes an extension portion opposite to said hook member, said mounting assembly includes a stopper pin mounted at a preselected location on said mounting assembly to prevent said lever assembly from over rotating and said hook member sliding over and out of said locking assembly.

9. The car door safety device of claim 1 further including an electrical switch lever assembly having a sloping member mounted thereon said car door safety device.

10. The car door safety device of claim 1 wherein said hook member includes a material with a higher coefficient of friction applied to a portion of said hook member that comes into contact with said first end of said locking assembly.

11. The car door safety device of claim 1 wherein a shaft is passed through a ball bearing which is housed in a ball bearing housing, said shaft mounting said lever assembly to said mounting assembly.

12. The car door safety device of claim 1 wherein at least one adjustment member is used to mount said hook to said lever assembly.

13. The car door safety device of claim 12 wherein three adjustment members are used.

14. The car door safety device of claim 1 wherein said car door safety device is mounted to an outer area of a car door.

* * * * *